US010118788B2

(12) United States Patent
Fukasawa et al.

(10) Patent No.: US 10,118,788 B2
(45) Date of Patent: Nov. 6, 2018

(54) PRINT MEDIUM FINISHING APPARATUS, IMAGE FORMING SYSTEM, AND MOVING STRUCTURE EMPLOYED THEREIN

(71) Applicant: S-PRINTING SOLUTION CO., LTD., Suwon-si, Gyeonggi-do (KR)

(72) Inventors: Eiji Fukasawa, Suwon-si (KR); Tae-hong Kim, Yongin-si (KR); Tae-jin Baek, Suwon-si (KR); Min-gi Kim, Suwon-si (KR); Joon-sik An, Bucheon-si (KR); Jin-soo Lee, Yongin-si (KR); Hae-seog Jo, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/648,903

(22) Filed: Jul. 13, 2017

(65) Prior Publication Data

US 2018/0029819 A1 Feb. 1, 2018

(30) Foreign Application Priority Data

Jul. 29, 2016 (KR) ..... 10-2016-0097032

(51) Int. Cl.
*B65H 31/30* (2006.01)

(52) U.S. Cl.
CPC ..... *B65H 31/30* (2013.01); *B65H 31/3036* (2013.01); *B65H 31/3045* (2013.01); *B65H 2301/4224* (2013.01); *B65H 2301/42268* (2013.01)

(58) Field of Classification Search
CPC .. B65H 2301/4224; B65H 2301/42268; B65H 31/3036; B65H 31/3045
USPC ..... 270/58.07, 58.27
See application file for complete search history.

(56) References Cited

U.S. PATENT DOCUMENTS

| | | | |
|---|---|---|---|
| 7,487,959 | B2 | 2/2009 | Noh |
| 7,832,718 | B2 * | 1/2010 | Fukasawa et al. |
| 7,992,856 | B2 * | 8/2011 | Saito |
| 8,191,884 | B2 * | 6/2012 | Sato et al. |
| 8,523,166 | B2 | 9/2013 | Jung |
| 8,960,660 | B2 * | 2/2015 | Furuhashi et al. |
| 9,725,272 | B2 * | 8/2017 | Kimura et al. |

FOREIGN PATENT DOCUMENTS

| | | | |
|---|---|---|---|
| KR | 10-0405324 | 10/2003 | |
| KR | 10-1268552 | 5/2013 | |
| WO | WO-2017111281 A1 * | 6/2017 | ..... B41J 13/00 |

* cited by examiner

*Primary Examiner* — Leslie A Nicholson, III
(74) *Attorney, Agent, or Firm* — Staas & Halsey LLP

(57) ABSTRACT

Provided is a print medium finishing apparatus including a print medium stacking plate; a stacker tray; and a print medium discharging apparatus configured to discharge, to the stacker tray, print media on the print medium stacking plate, wherein the print medium discharging apparatus includes at least one driving gear that is rotatable; a moving member configured to move linearly and curvilinearly with respect to the at least one driving gear and including a motion converting gear configured to engage the at least one driving gear and convert rotation of the at least one driving gear into a linear motion and a curvilinear motion; and a grip member configured to be moved linearly and curvilinearly by the moving member while holding the print media on the print medium stacking plate, and to place the print media on the stacker tray.

19 Claims, 21 Drawing Sheets

PRINT MEDIUM FINISHING APPARATUS, IMAGE FORMING SYSTEM, AND MOVING STRUCTURE EMPLOYED THEREIN

CROSS-REFERENCE TO RELATED APPLICATION

This application claims the benefit of Korean Patent Application No. 10-2016-0097032, filed on Jul. 29, 2016, in the Korean Intellectual Property Office, the disclosure of which is incorporated herein in its entirety by reference.

BACKGROUND

1. Field

The present disclosure relates to a print medium finishing apparatus, an image forming system, and a moving structure employed therein.

2. Description of the Related Art

A print medium finishing apparatus aligns print media on which images are formed. Next, the print medium finishing apparatus may perform post-processing such as punching processing or bookbinding processing on the print media.

Such a print medium finishing apparatus may include a print medium stacking plate on which print media may be loaded, a stacker tray disposed at a position lower than the print medium stacking plate, and a print medium discharging apparatus that discharges print media on the print medium stacking plate to the stacker tray.

The print medium discharging apparatus may be categorized into a type that pushes print media toward a stacker tray and a type that transports print media toward the stacker tray while holding the print media.

A print medium discharging apparatus that pushes print media has a simple structure. However, print media may be misaligned while the print media is being placed on the stacker tray.

On the other hand, a print medium discharging apparatus that transports print media while holding the print media is capable of placing the print media on a stacker tray without being misaligned. However, a structure for moving and controlling a position of a grip member that holds print media may become complicated.

SUMMARY

Provided are a print medium finishing apparatus capable of controlling a position of a grip member and having a simple structure, an image forming system, and a moving structure included therein.

Provided are a smaller-sized moving structure for moving a grip member, for saving space, a print medium finishing apparatus, and an image forming system employing the same.

Additional aspects will be set forth in part in the description which follows and, in part, will be apparent from the description, or may be learned by practice of the presented embodiments.

According to an aspect of an embodiment, a print medium finishing apparatus includes a print medium stacking plate; a stacker tray disposed at a location lower than the print medium stacking plate; and a print medium discharging apparatus configured to discharge, to the stacker tray, print media on the print medium stacking plate, wherein the print medium discharging apparatus includes at least one driving gear that is rotatable; a moving member configured to move linearly and curvilinearly with respect to the at least one driving gear and including a motion converting gear configured to engage the at least one driving gear and convert rotation of the at least one driving gear into a linear motion and a curvilinear motion; and a grip member configured to be moved linearly and curvilinearly by the moving member while holding the print media on the print medium stacking plate, and to place the print media on the stacker tray.

The at least one driving gear may include a separating-preventing protrusion, and the moving member may include a separating-preventing groove capable of accommodating the separating-preventing protrusion and extending so as to be a constant distance apart from the motion converting gear.

The motion converting gear may include at least one straight gear portion in which a plurality of gear teeth are arranged linearly; a first curved gear portion arranged at a first end of the at least one straight gear portion and including a plurality of gear teeth arranged curvilinearly; and a second curved gear portion arranged at a second end of the at least one straight gear portion and including a plurality of gear teeth curvilinearly.

The at least one straight gear portion may include a first straight gear portion and a second straight gear portion that are parallel to each other, the first curved gear portion may be configured to interconnect a first end of the first straight gear portion and a first end of the second straight gear portion, and the second curved gear portion may be configured to interconnect a second end of the first straight gear portion and a second end of the second straight gear portion.

A path along which the moving member moves may include a straight path parallel to the at least one straight gear portion, a first curved path parallel to the first curved gear portion, and a second curved path parallel to the second curved gear portion.

The grip member may be fixed to the moving member, and a path along which the grip member moves may be identical to the path along which the moving member moves.

The print medium finishing apparatus may further include a moving guide that movably supports the moving member, wherein the moving guide may include a first guide configured to support the moving member such that the moving member is slidable in a first direction and a second guide configured to support the first guide such that the first guide is slidable in a second direction different from the first direction.

The motion converting gear and the at least one driving gear may be configured to circumscribe each other.

The at least one driving gear may include a first driving gear and a second driving gear.

The separating-preventing protrusion may include a first separating-preventing protrusion disposed at the first driving gear and having a first length and a second separating-preventing protrusion disposed at the second driving gear and having a second length greater than the first length, and the separating-preventing groove may include a first separating-preventing groove capable of accommodating the first separating-preventing protrusion and having a first depth and a second separating-preventing groove capable of accommodating the second separating-preventing protrusion and having a second depth greater than the first depth.

According to an aspect of another embodiment, a moving structure includes at least one driving gear that is rotatable; and a moving member configured to move linearly and curvilinearly with respect to the at least one driving gear and including a motion converting gear configured to engage the at least one driving gear and convert rotation of the at least one driving gear into a linear motion and a curvilinear motion.

The at least one driving gear may include a separating-preventing protrusion, and the moving member may include a separating-preventing groove capable of accommodating the separating-preventing protrusion and extending so as to be a constant distance apart from the motion converting gear.

The motion converting gear may include at least one straight gear portion in which a plurality of gear teeth are arranged linearly; a first curved gear portion arranged at a first end of the at least one straight gear portion and including a plurality of gear teeth arranged curvilinearly; and a second curved gear portion arranged at a second end of the at least one straight gear portion and including a plurality of gear teeth arranged curvilinearly.

The at least one straight gear portion may include a first straight gear portion and a second straight gear portion that are parallel to each other, the first curved gear portion may be configured to interconnect a first end of the first straight gear portion and a first end of the second straight gear portion, and the second curved gear portion may be configured to interconnect a second end of the first straight gear portion and a second end of the second straight gear portion.

A path along which the moving member moves may include a straight path parallel to the at least one straight gear portion, a first curved path parallel to the first curved gear portion, and a second curved path parallel to the second curved gear portion.

The print medium finishing apparatus may further include a moving guide that movably supports the moving member, wherein the moving guide may include a first guide configured to support the moving member such that they moving member is slidable in a first direction and a second guide configured to support the first guide such that the first guide is slidable in a second direction different from the first direction.

The motion converting gear and the at least one driving gear may be configured to circumscribe each other.

The at least one driving gear may include a first driving gear and a second driving gear.

The separating-preventing protrusion may include a first separating-preventing protrusion disposed at the first driving gear and having a first length and a second separating-preventing protrusion disposed at the second driving gear and having a second length greater than the first length, and the separating-preventing groove may include a first separating-preventing groove capable of accommodating the first separating-preventing protrusion and having a first depth and a second separating-preventing groove capable of accommodating the second separating-preventing protrusion and having a second depth greater than the first depth.

According to an aspect of another embodiment, an image forming system includes an image forming apparatus configured to form an image on a print medium; and a print medium finishing apparatus configured to align print media having images formed thereon, wherein the print medium finishing apparatus includes a print medium stacking plate; a stacker tray disposed at a location lower than the print medium stacking plate; and a print medium discharging apparatus configured to discharge, to the stacker tray, print media on the print medium stacking plate, and the print medium discharging apparatus includes at least one driving gear that is rotatable; a moving member configured to move linearly and curvilinearly with respect to the at least one driving gear and including a motion converting gear configured to engage the at least one driving gear and convert rotation of the at least one driving gear into a linear motion and a curvilinear motion; and a grip member configured to be moved linearly and curvilinearly by the moving member while holding the print media on the print medium stacking plate, and to place the print media on the stacker tray.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1A:
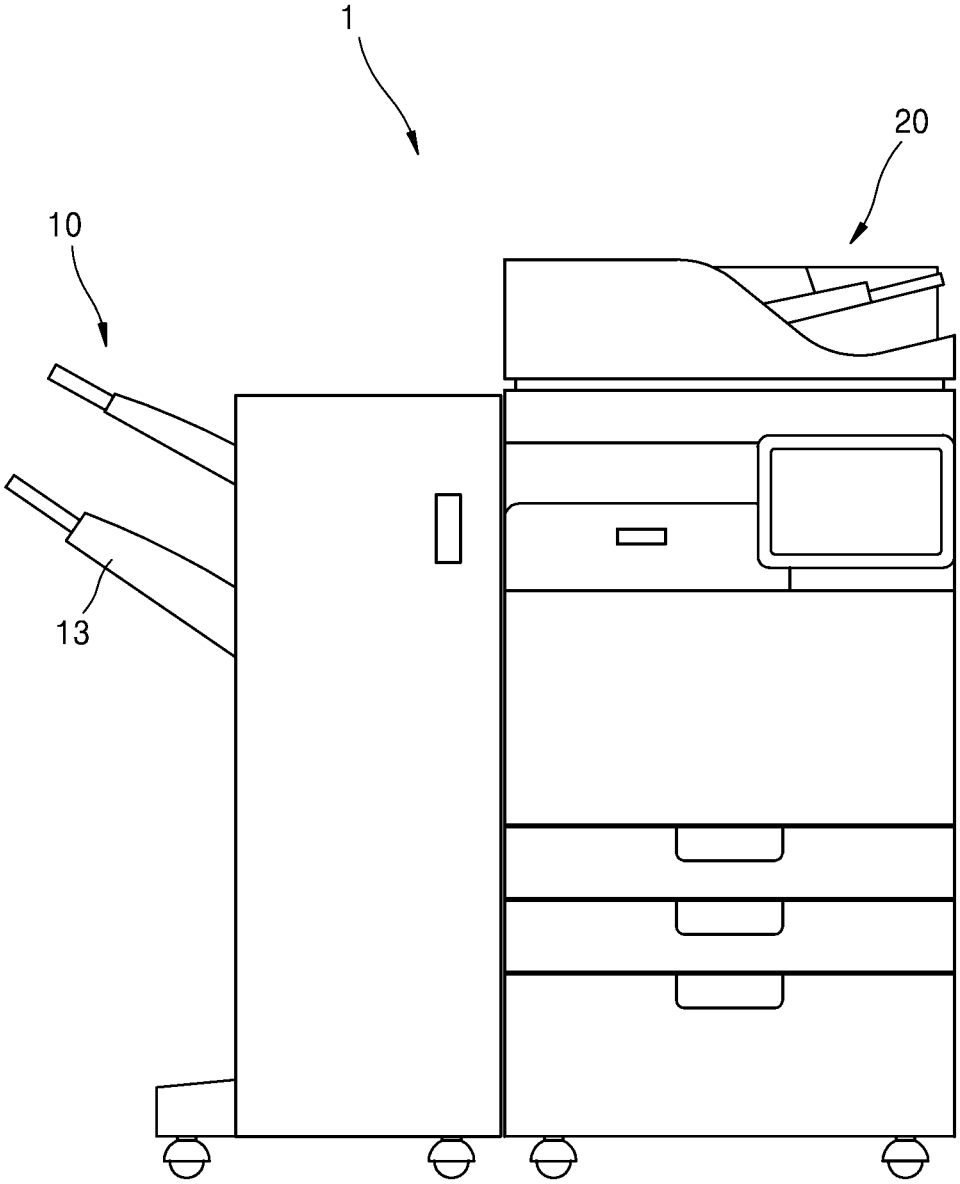
FIG. 1A is a front view of an image forming system 1 according to an example embodiment.

Hereinafter, the configuration and operation of the present disclosure will be described in detail with reference to the embodiments of the accompanying drawings.

The terms used in this specification will be briefly described, and the present disclosure will be described in detail.

With respect to the terms in the various embodiments of the present disclosure, the general terms which are currently and widely used are selected in consideration of functions of structural elements in the various embodiments of the present disclosure. However, meanings of the terms may be changed according to intention, a judicial precedent, appearance of a new technology, and the like. In addition, in certain cases, a term which is not commonly used may be selected. In such a case, the meaning of the term will be described in detail at the corresponding part in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements.

It will be understood that although the terms "first", "second", etc. may be used herein to describe various components, these components should not be limited by these terms. These components are only used to distinguish one component from another.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Therefore, the embodiments are merely described below, by referring to the figures, to explain aspects. Expressions such as "at least one of," when preceding a list of elements, modify the entire list of elements and do not modify the individual elements of the list.

Figure 1B:
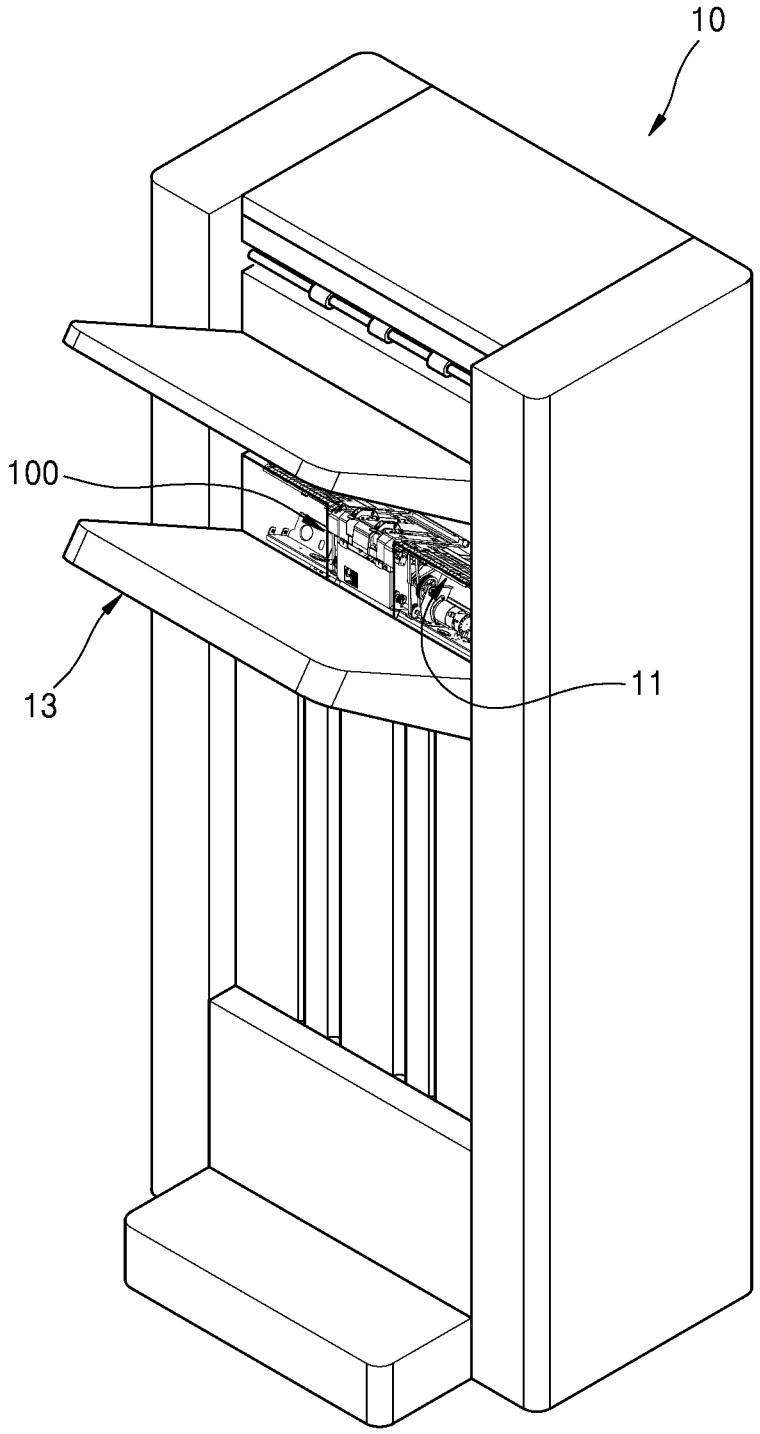
FIG. 1B is a perspective view of a print medium finishing apparatus of FIG. 1A.

FIG. 1A is a front view of an image forming system 1 according to an example embodiment, and FIG. 1B is a perspective view of a print medium finishing apparatus 10 of FIG. 1A.

Figure 2:
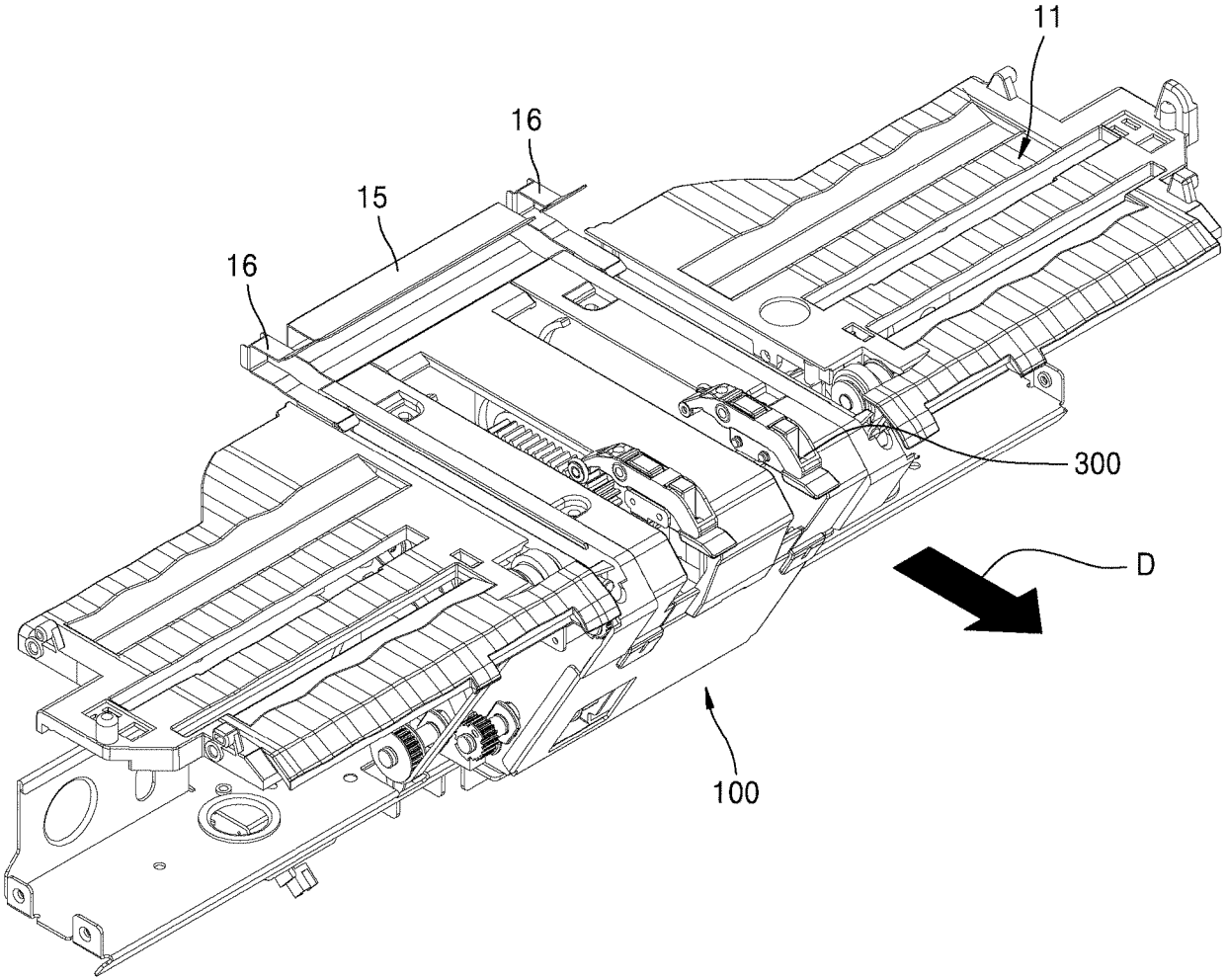
FIG. 2 is a perspective view of a print medium discharging apparatus of FIG. 1B.

FIG. 2 is a perspective view of a print medium discharging apparatus 100 of FIG. 1B.

Referring to FIG. 1A, the image forming system 1 includes an image forming apparatus 20 and the print medium finishing apparatus 10. The image forming apparatus 20 forms an image on at least one surface of a print medium P. The print medium finishing apparatus 10 aligns and loads a plurality of media P on which images are formed by the image forming apparatus 20.

As shown in FIG. 1A, the print medium finishing apparatus 10 may be, but is not limited to, an independent component that is separate from the image forming apparatus 20. For example, although not shown, the print medium finishing apparatus 10 may also be disposed inside the image forming apparatus 20 as a component of the image forming apparatus 20.

Referring to FIG. 1B, the print medium finishing apparatus 10 includes a print medium stacking plate 11, a stacker tray 13, and the print medium discharging apparatus 100.

The stacker tray 13 loads the print medium P thereon and may be moved upward and downward. The stacker tray 13 may be exposed to the outside, and thus a user may easily retrieve the loaded print medium P. The state in which the stacker tray 13 is exposed to the outside may include not only a state in which it protrudes outward as shown in FIG. 1B, but also a state in which it is inserted inside the print medium finishing apparatus 10 such that a user may easily insert his/her hand thereinto.

Referring to FIG. 2, a plurality of print media P may be loaded onto the print medium stacking plate 11. A fixed stopper 15, whose position is fixed, may be disposed at the center of the print medium stacking plate 11. At both ends of the fixed stopper 15, a pair of movable stoppers 16 that may be moved back and forth in a print medium discharging direction D are respectively disposed.

The plurality of print media P loaded on the print medium stacking plate 11 may be aligned by the fixed stopper 15 and the pair of movable stoppers 16. The pair of movable stoppers 16 may move the aligned plurality of print media P by a certain distance in the print medium discharging direction D.

At the center of the print medium stacking plate 11, there is disposed the print medium discharging apparatus 100 for discharging the print medium P on the print medium stacking plate 11 to the stacker tray 13. The print medium discharging apparatus 100 includes a grip member 300 that moves along a certain moving path 3000 (refer to FIG. 3A).

The grip member 300 may be moved while holding the plurality of print media P aligned on the print medium stacking plate 11 and place the plurality of print media P onto the stacker tray 13 without misaligning the plurality of print media P.

When the grip member 300 is pushed when it is not holding the plurality of print media P, the plurality of print media P may be misaligned when the plurality of print media P are dropped onto the stacker tray 13 located lower than the print medium stacking plate 11.

However, in the print medium discharging apparatus 100 according to an example embodiment, since the plurality of print media P are placed on the stacker tray 13 while being held by the grip member 300, misalignment of the plurality of print media P may be prevented when they are being dropped onto the stacker tray 13.

FIGS. 3A through 3G are diagrams for describing operations of the grip member 300 of the print medium discharging apparatus 100 of FIG. 2. Here, in FIGS. 3A through 3G, the moving path of a rotation shaft A1 of the grip member 300 is indicated by a dotted line.

Figure 3A:
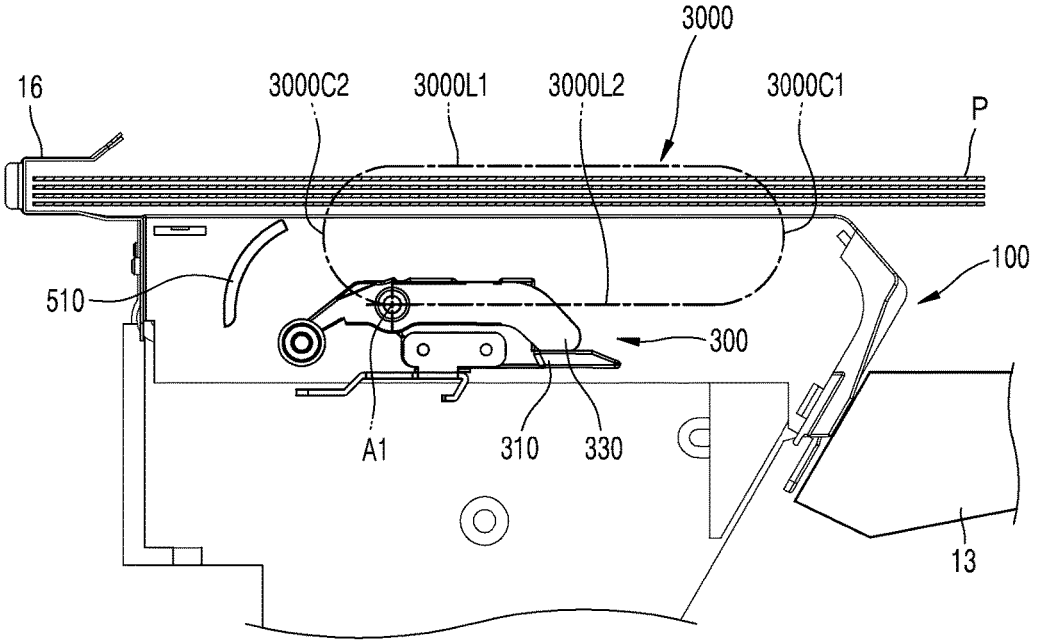
FIGS. 3A through 3G are diagrams for describing operations of a grip member of the print medium discharging apparatus of FIG. 2.

Referring to FIG. 3A, the grip member 300 includes a base 310 and a gripper 330 that may be rotated around the rotation shaft A1 in relation to the base 310. Although not shown, an elastic member (not shown) is disposed between the gripper 330 and the base 310, and thus the gripper 330 is elastically biased to rotate in the clockwise direction around the rotation shaft A1.

First ends of the plurality of print media P on the print medium stacking plate 11 are aligned by the fixed stopper 15 and the movable stoppers 16.

Figure 3B:
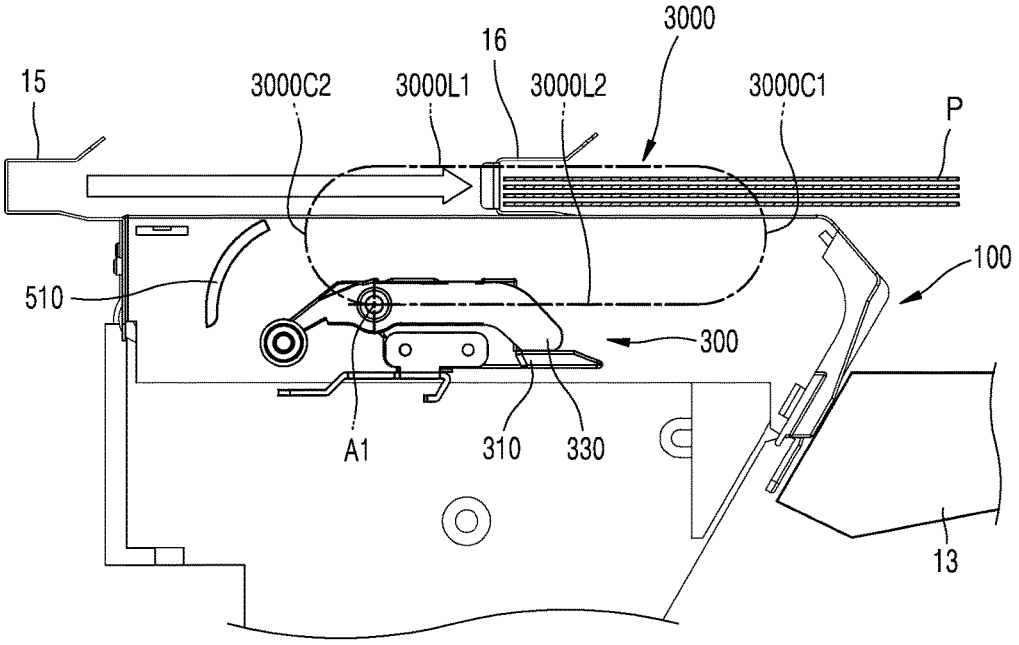

Referring to FIG. 3B, as the movable stoppers 16 move a certain distance in the print medium discharging direction D, the plurality of print media P are transported by a certain distance.

Figure 3C:
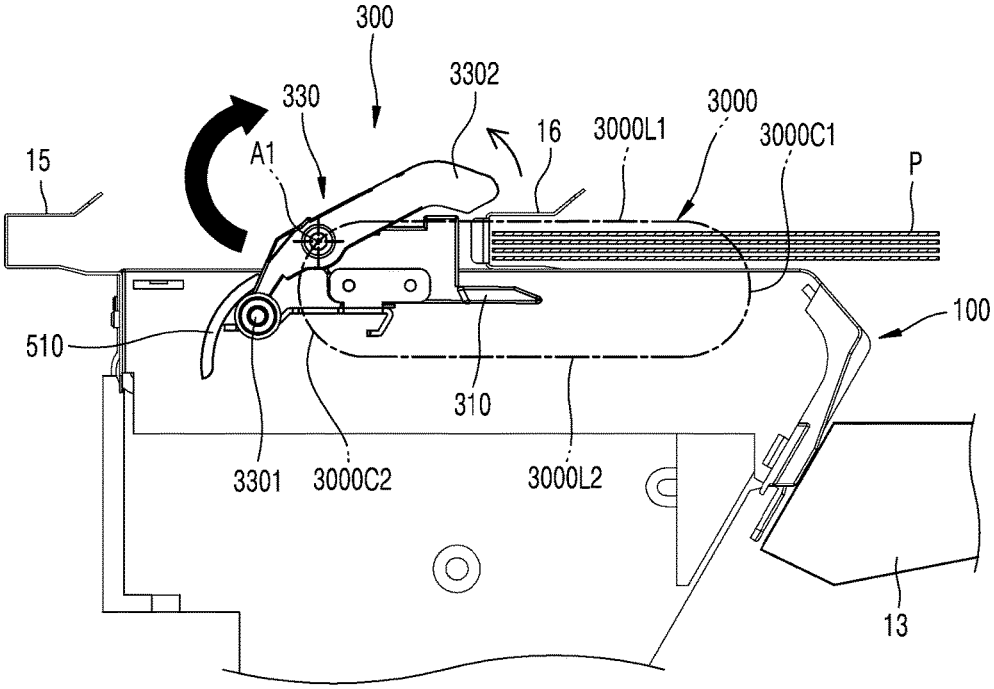

Referring to FIG. 3C, the grip member 300 moves upward curvilinearly. While the grip member 300 is moving curvilinearly, a first end of the gripper 330 is pressed by a cam. Therefore, the gripper 330 rotates in a counterclockwise direction, and thus the print media P may be inserted between a second end of the grip member 300 and the base 310.

Figure 3D:
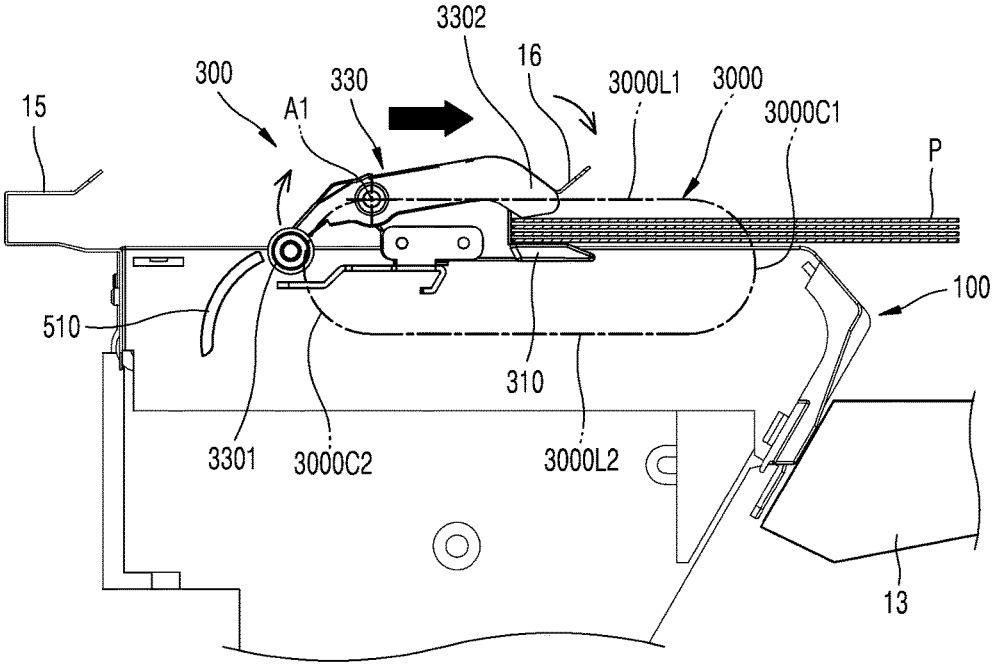

Referring to FIG. 3D, while the grip member 300 is moving, a first end 3301 of the gripper 330 and a cam 510, which are in contact with each other, are separated. Therefore, the gripper 330 is rotated in the clockwise direction by an elastic bias, and thus the print media P disposed between a second end 3302 of the gripper 330 and the base 310 are pressed by the second end 3302. Thus, the plurality of print media P are held by the grip member 300.

Figure 3E:
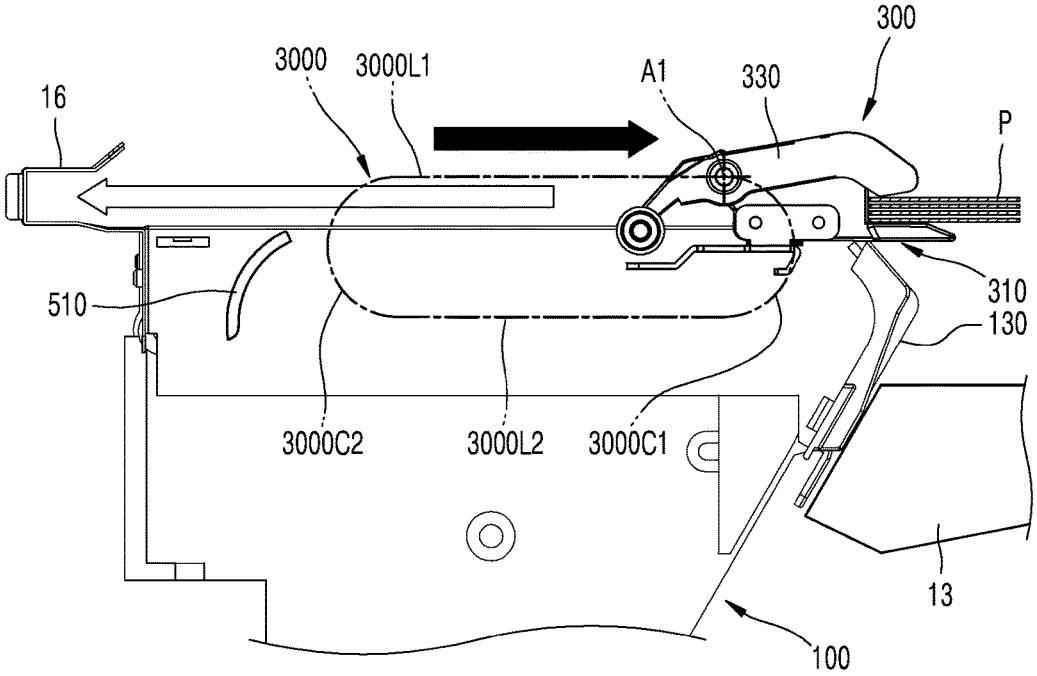

Referring to FIG. 3E, as the grip member 300 linearly moves along the print medium discharging direction D, the plurality of print media P held by the grip member 300 are moved linearly while alignment thereof is maintained. At this time, the movable stoppers 16 may move in a direction opposite to the moving direction of the grip member 300 and return to their original positions.

Figure 3F:
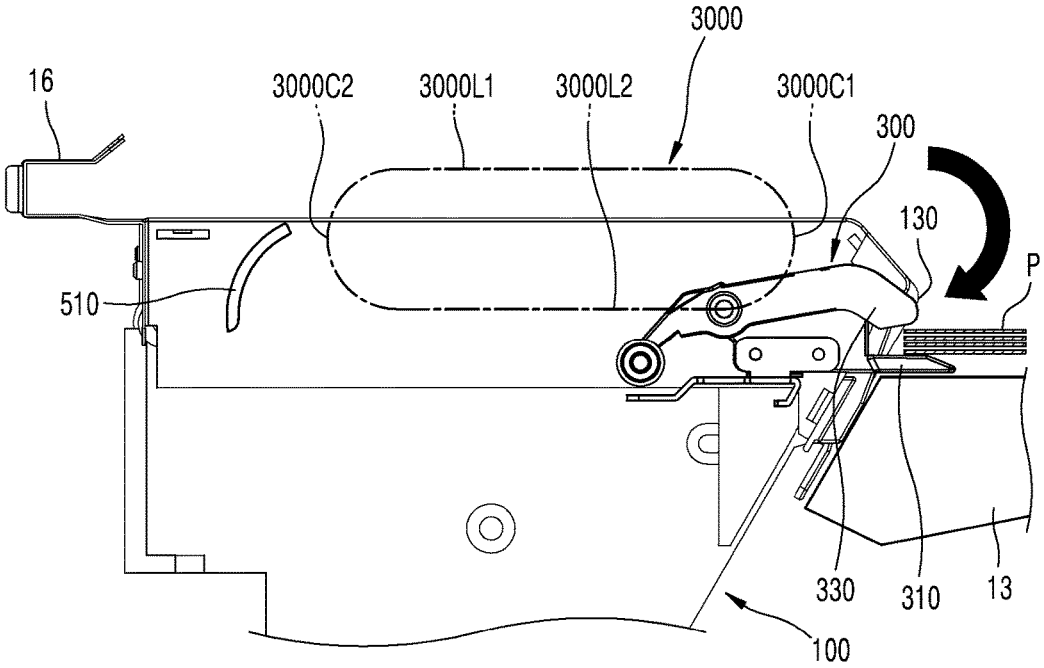

Referring to FIG. 3F, the grip member 300 moves downward curvilinearly while holding the plurality of print media P. The grip member 300 moves downward and forward in some sections and moves downward and backward in some other sections. During these processes, the plurality of print media P are placed on the stacker tray 13 while being held by the grip member 300.

Figure 3G:
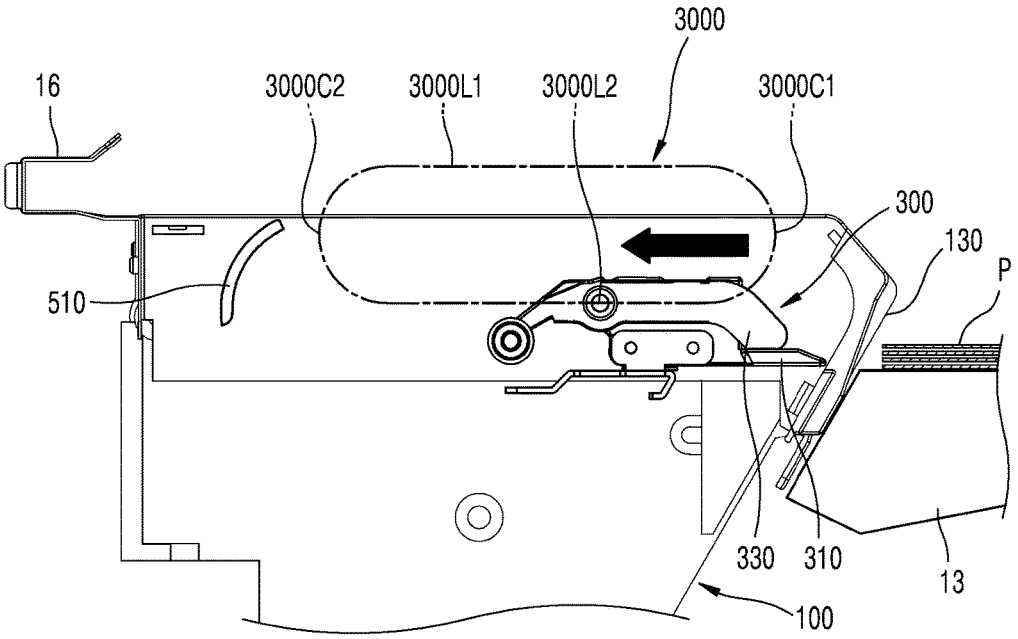

Referring to FIG. 3G, the grip member 300 moves linearly in a direction opposite to the print medium discharging direction D. Movement of the plurality of print media P is restricted by a wall 130 of the print medium discharging apparatus 100 while the grip member 300 is moving in the direction opposite to the print medium discharging direction D. Therefore, the plurality of print media P are separated from the grip member 300 and placed on the stacker tray 13 without being misaligned.

The moving path 3000 of the grip member 300 may include a first straight moving path 3000L1, a first curved moving path 3000C1, a second straight moving path 3000L2, and a second curved moving path 3000C2. As the grip member 300 moves along the second curved moving path 3000C2, the grip member 300 prepares to hold the print media P. While the grip member 300 is moving along the first straight moving path 3000L1 and the first curved moving path 3000C1, the grip member 300 moves linearly and curvilinearly while holding the print media P on the print medium stacking plate 11 to prevent the print media from being misaligned and places the print media P onto the stacker tray 13. While the grip member 300 is moving along the second straight moving path 3000L2, the print media P is detached from the grip member 300 and loaded onto the stacker tray 13.

The print medium discharging apparatus 100 according to an example embodiment includes a simple and stable moving structure that constitutes the above-described moving path 3000.

Figure 4A:
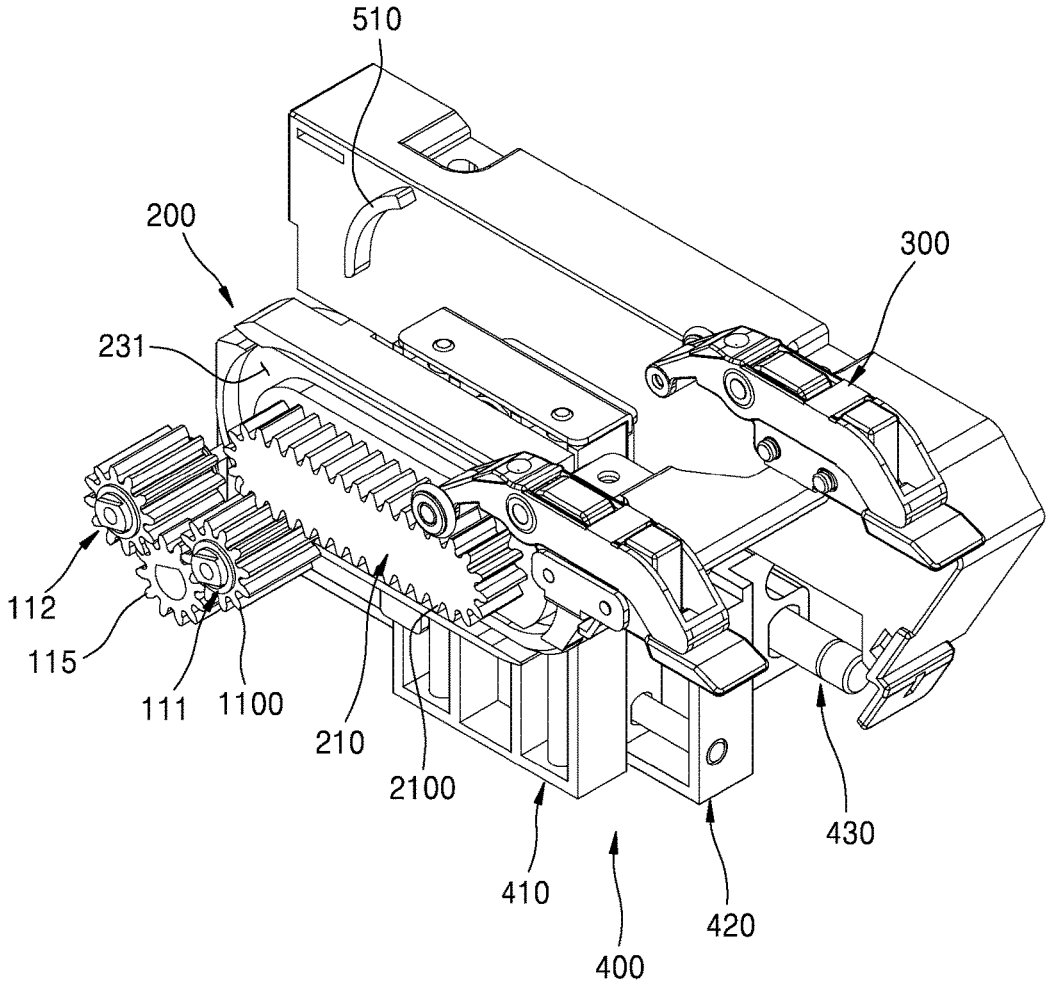
FIGS. 4A and 4B are respectively a perspective view diagram and a front view diagram for describing a moving structure.
Figure 4B:
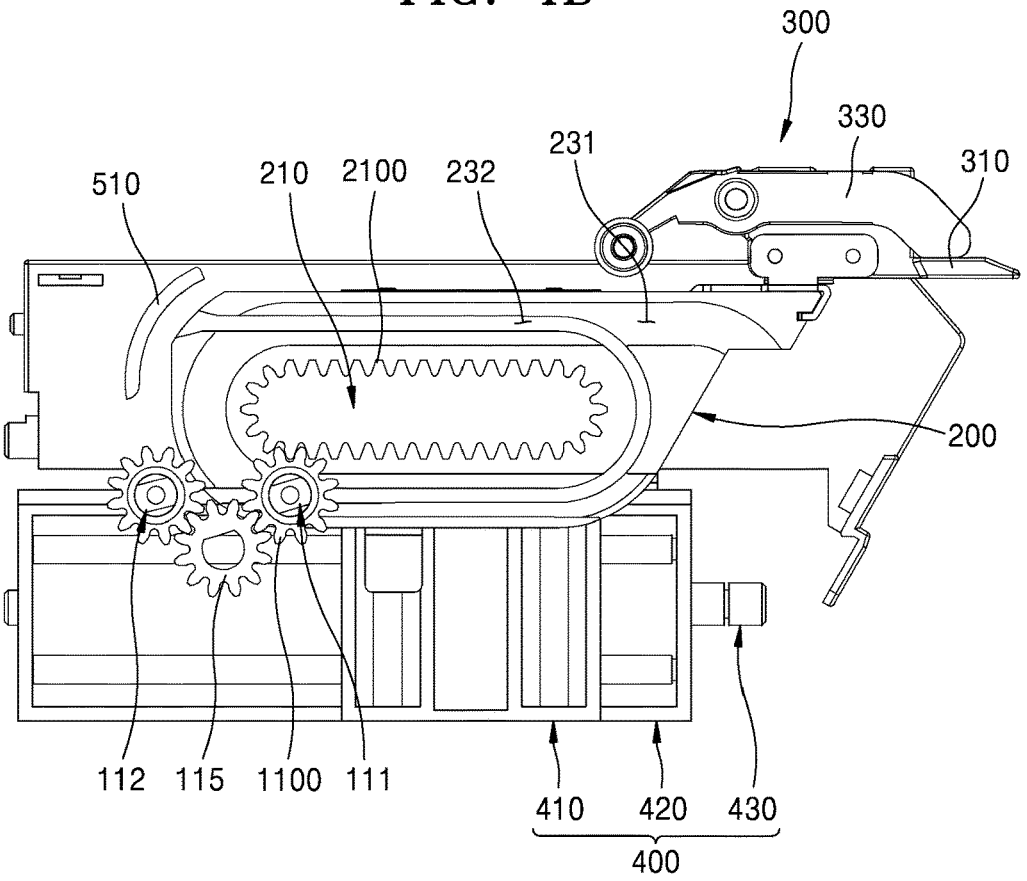
Figure 5:
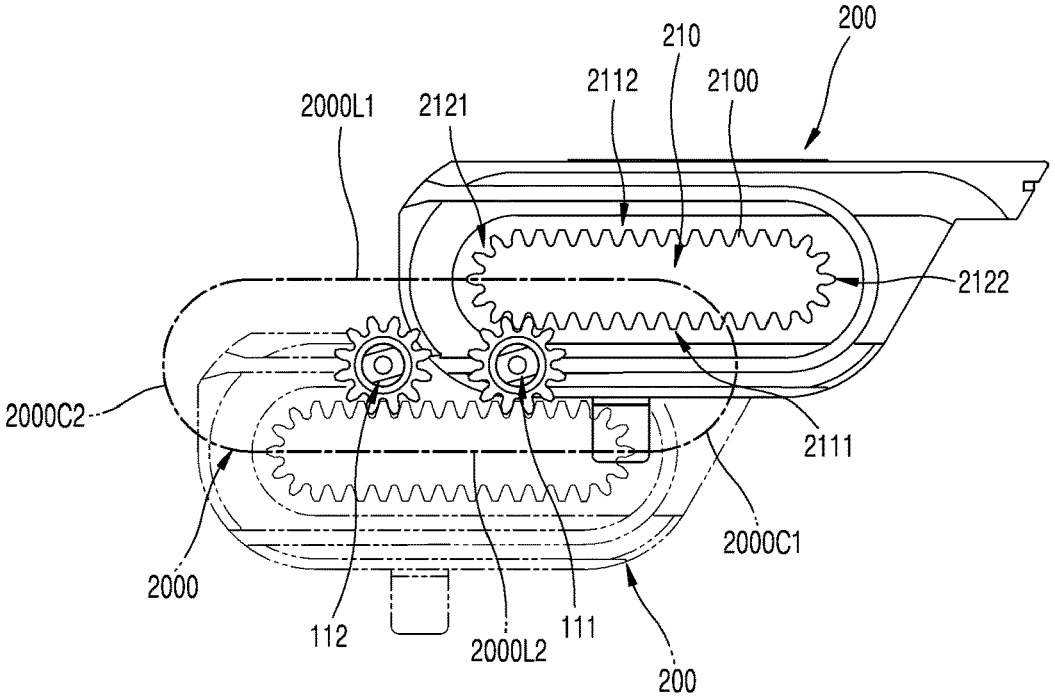
FIG. 5 is a front view diagram for describing the movement of a moving member of the moving structure of FIG. 4B.

FIGS. 4A and 4B are respectively a perspective view diagram and a front view diagram for describing a moving structure. FIG. 5 is a front view diagram for describing the movement of a moving member 200 of the moving structure of FIG. 4B.

Referring to FIGS. 4A and 4B, the moving structure includes driving gears 111 and 112 and the moving member 200 that is moved by the driving gears 111 and 112.

The driving gears 111 and 112 may be rotated and locations thereof are fixed. The driving gears 111 and 112 may contact the moving member 200 and a plurality of gear teeth 1100 are arranged on outer circumferential surfaces of the driving gears 111 and 112.

The driving gears 111 and 112 may receive driving power from another component, e.g., a connecting gear 115. However, the driving gears 111 and 112 are not limited thereto and may self-generate power.

The moving member 200 includes a motion converting gear 210 so that it may be moved by the driving gears 111 and 112. The motion converting gear 210 engages the driving gears 111 and 112 and converts the rotating motions of the driving gears 111 and 112 into a straight linear motion and a curvilinear motion.

Due to the motion converting gear 210, the moving member 200 moves linearly and curvilinearly in relation to the driving gears 111 and 112.

Referring to FIG. 5, the motion converting gear 210 and the driving gears 111 and 112 circumscribe each other. The motion converting gear 210 includes straight gear portions 2111 and 2112 for converting the rotating motions of the driving gears 111 and 112 into a straight linear motion of the moving member 200 and a curved gear portions 2121 and 2122 for converting the rotating motion of the driving gears 111 and 112 into a curvilinear motion.

At the straight gear portions 2111 and 2112, a plurality of gear teeth 2100 are arranged linearly. The straight gear portions 2111 and 2112 include a first straight gear portion 2111 and a second straight gear portion 2112 arranged in parallel with each other.

At the curved gear portions 2121 and 2122, the plurality of gear teeth 2100 are arranged curvilinearly. The curved gear portions 2121 and 2122 include a first curved gear portion 2121 and a second curved gear portion 2122. The first curved gear portion 2121 is disposed at a first end of the first straight gear portion 2111, where the plurality of gear teeth 2100 are arranged curvilinearly. The second curved gear portion 2122 is disposed at a second end of the first straight gear portion 2111, where the plurality of gear teeth 2100 are arranged curvilinearly.

The first curved gear portion 2121 may interconnect a first end of the first straight gear portion 2111 and a first end of the second straight gear portion 2112. For example, the plurality of gear teeth 2100 of the first curved gear portion 2121 may be arranged in a semicircular manner.

The second curved gear portion 2122 may connect a second end of the first straight gear portion 2111 to a second end of the second straight gear portion 2112. For example, the plurality of gear teeth 2100 of the second curved gear portion 2122 may be arranged in a semicircular manner.

As the driving gears 111 and 112 rotate in the clockwise direction while engaging the motion converting gear 210, the motion converting gear 210 moves linearly and curvilinearly according to the shapes of the driving gears 111 and 112. The moving member 200 including the motion converting gear 210 moves linearly and curvilinearly.

For example, while the driving gears 111 and 112 are engaged with the first straight gear portion 2111 and rotating, the motion converting gear 210 and the moving member 200 including the motion converting gear 210 move along a first straight moving path 2000L1 parallel to the first straight gear portion 2111. As the driving gears 111 and 112 continue to rotate, the driving gears 111 and 112 pass through the first straight gear portion 2111 and then sequentially engage the first curved gear portion 2121 and the second straight gear portion 2112. During this process, the motion converting gear 210 and the moving member 200 including the same move along a first curved moving path 2000C1 parallel to the second curved gear portion 2122, a second straight moving path 2000L2 parallel to the second curved gear portion 2122, and a second curved moving path 2000C2 parallel to the first curved gear portion 2121. In other words, the moving member 200 moves along a moving path parallel to a direction in which the plurality of gear teeth 2100 of the motion converting gear 210 are arranged.

Figure 6A:
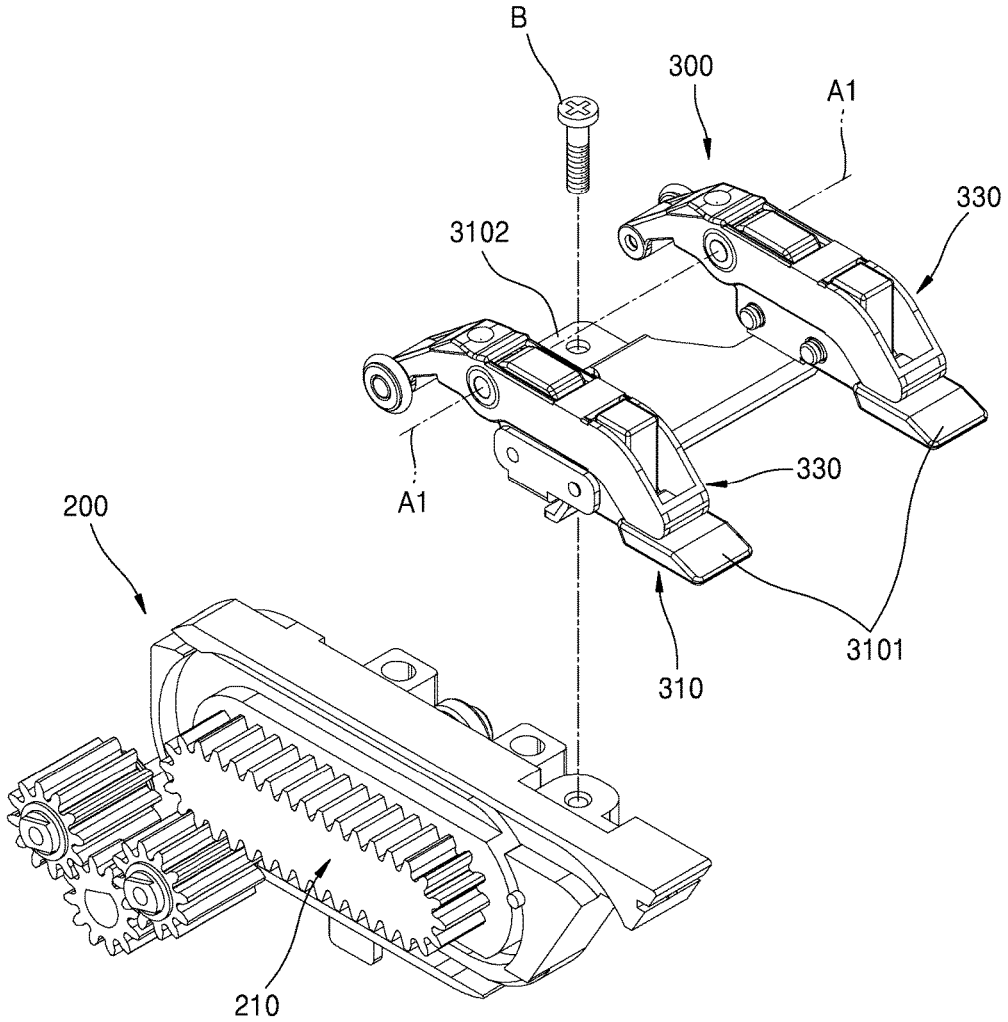
FIG. 6A is an exploded perspective view of the grip member and the moving member, according to an example embodiment.
Figure 6B:
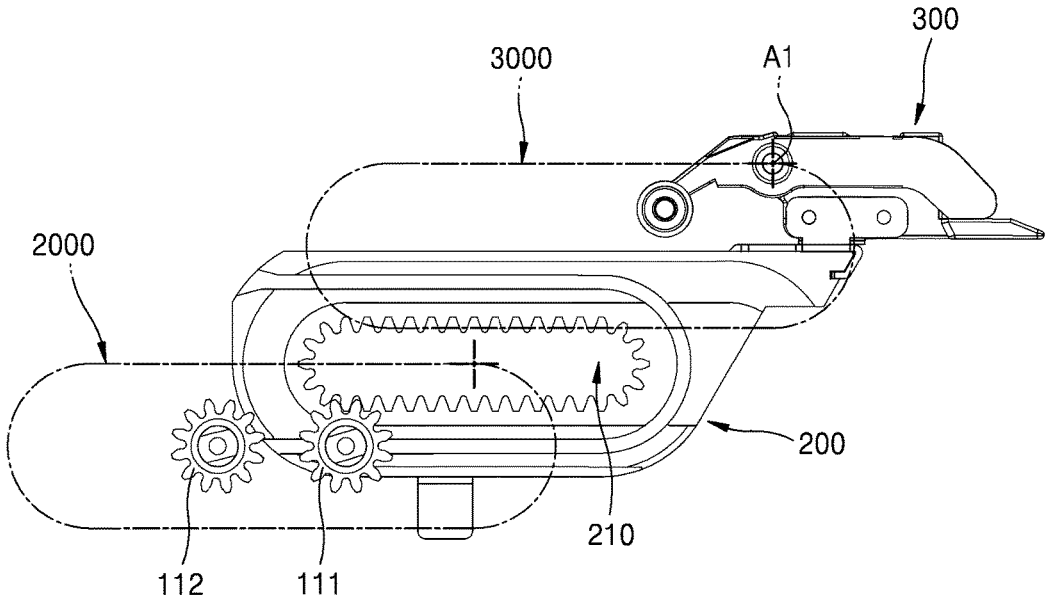
FIG. 6B is a front view diagram for describing a moving path of the grip member and the moving member, according to an example embodiment.

FIG. 6A is an exploded perspective view of the grip member 300 and the moving member 200, according to an example embodiment, and FIG. 6B is a diagram for describing a moving path of the grip member 300 and the moving member 200, according to an example embodiment.

Referring to FIG. 6A, the grip member 300 may be fixed in position to the moving member 200. For example, the grip member 300 may be fixed to the moving member 200 by a combining member B. However, the relationship between the grip member 300 and the moving member 200 is not limited thereto, and the grip member 300 and the moving member 200 may constitute a single body.

The grip member 300 may include a pair of grippers 330 installed on the base 310 and the base 310 so as to be rotatable around the rotation shaft A1. The base 310 includes a pair of grip regions 3101, which are opposed to second ends of the pair of grippers 330, and a fixed region 3102 fixed to the moving member 200.

Referring to FIG. 6B, since the grip member 300 is fixed in position to the moving member 200, the moving path 3000 of the grip member 300 may be identical to a moving path 2000 of the moving member 200. In other words, the grip members 300 may simultaneously move along the moving path 3000 that is identical to the moving path 2000 of the moving member 200.

Referring to FIGS. 6A and 6B, by fixing the base 310 to the moving member 200, the pair of grippers 330 are simultaneously fixed to the moving member 200. The pair of grippers 330 may be simultaneously moved by the moving member 200. Therefore, misalignment between the grippers 330, which may occur when the pair of grippers 330 move individually, may be prevented.

Figure 7A:
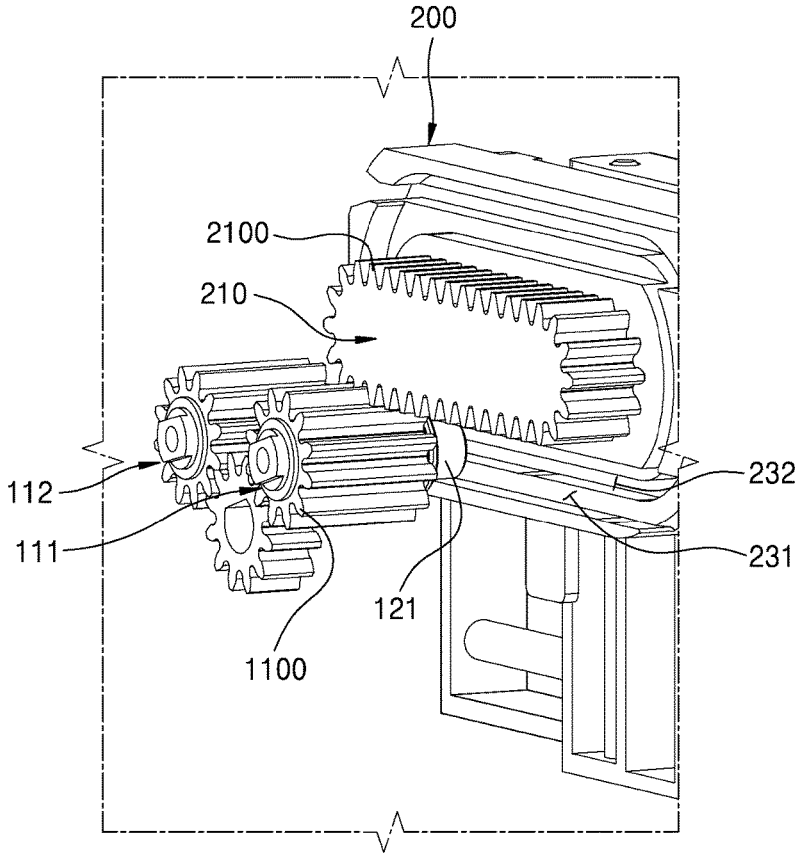
FIGS. 7A and 7B are diagrams for describing a separation-preventing structure of a moving structure, according to an example embodiment.
Figure 7B:
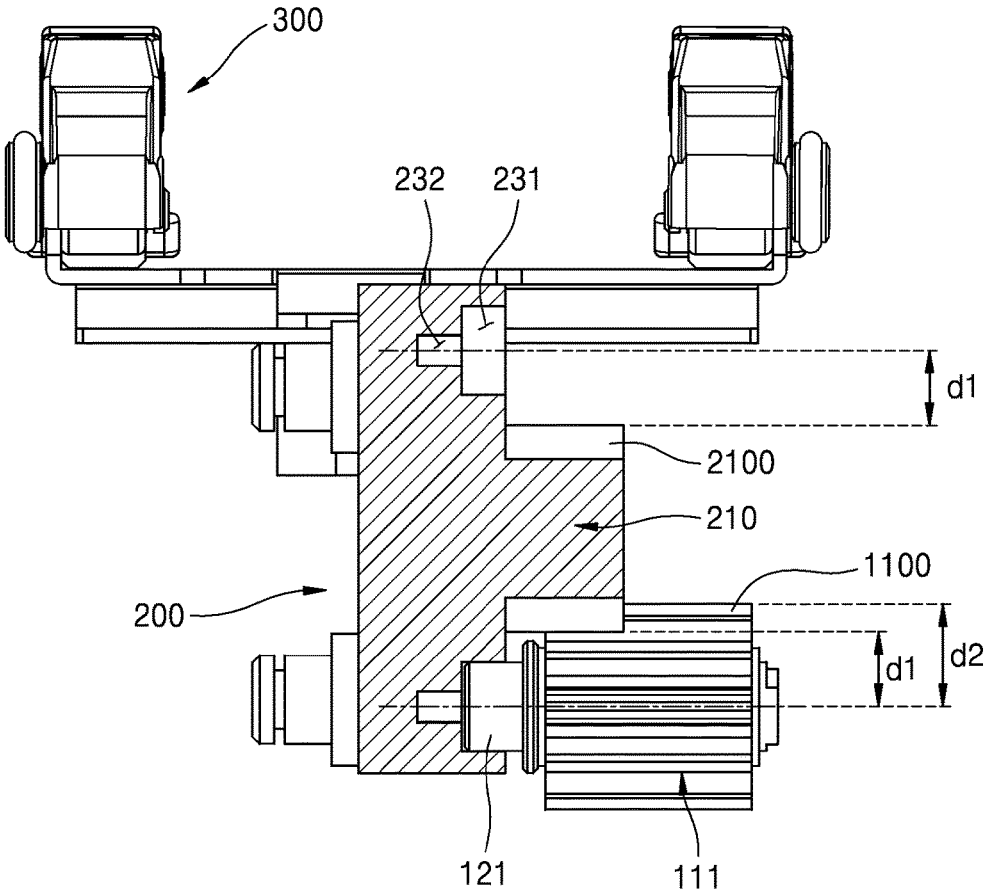

FIGS. 7A and 7B are diagrams for describing a separation-preventing structure of a moving structure according to an example embodiment. Referring to FIG. 7A, the moving structure further includes a separation-preventing structure that prevents the motion converting gear 210 from being separated from a driving gear.

The separation-preventing structure may include separating-preventing protrusions 121 and 122 disposed on the driving gears 111 and 112 and separating-preventing grooves 231 and 232 formed on the moving member 200, wherein the separating-preventing protrusions 121 and 122 may be inserted to the separating-preventing grooves 231 and 232.

The separating-preventing protrusions 121 and 122 may be disposed coaxially with the rotation axes of the driving gears 111 and 112. Thicknesses of the separating-preventing protrusions 121 and 122 are equal to widths of the separating-preventing grooves 231 and 232.

The separating-preventing grooves 231 and 232 extend so as to be a constant first distance d1 apart from the motion converting gear 210. Shapes of the separating-preventing grooves 231 and 232 are identical to those of imaginary lines interconnecting the plurality of gear teeth 2100 of the motion converting gear 210, but sizes of the separating-preventing grooves 231 and 232 may be different from each other. At least portions of the separating-preventing grooves 231 and 232 may coincide with the moving path 2000 of the moving member 200.

Referring to FIG. 7B, the first distance d1 may be a distance between a center of the separating-preventing grooves 231 and 232 and the gear teeth 2100 of the motion converting gear 210. The first distance d1 is smaller than a second distance d2 from the rotation axes of the driving gear 111 and 112 to the gear teeth 1100 of the driving gears 111 and 112. Gear engagement between the driving gears 111 and 112 and the motion converting gear 210 may be maintained by designing the first distance d1 to be smaller than the second distance d2.

As the driving gears 111 and 112 are rotated while the separating-preventing protrusions 121 and 122 are being inserted into the separating-preventing grooves 231 and 232, the power of the driving gears 111 and 112 is reliably transmitted to the motion converting gear 210, and thus the moving member 200 may be reliably moved.

Figure 8A:
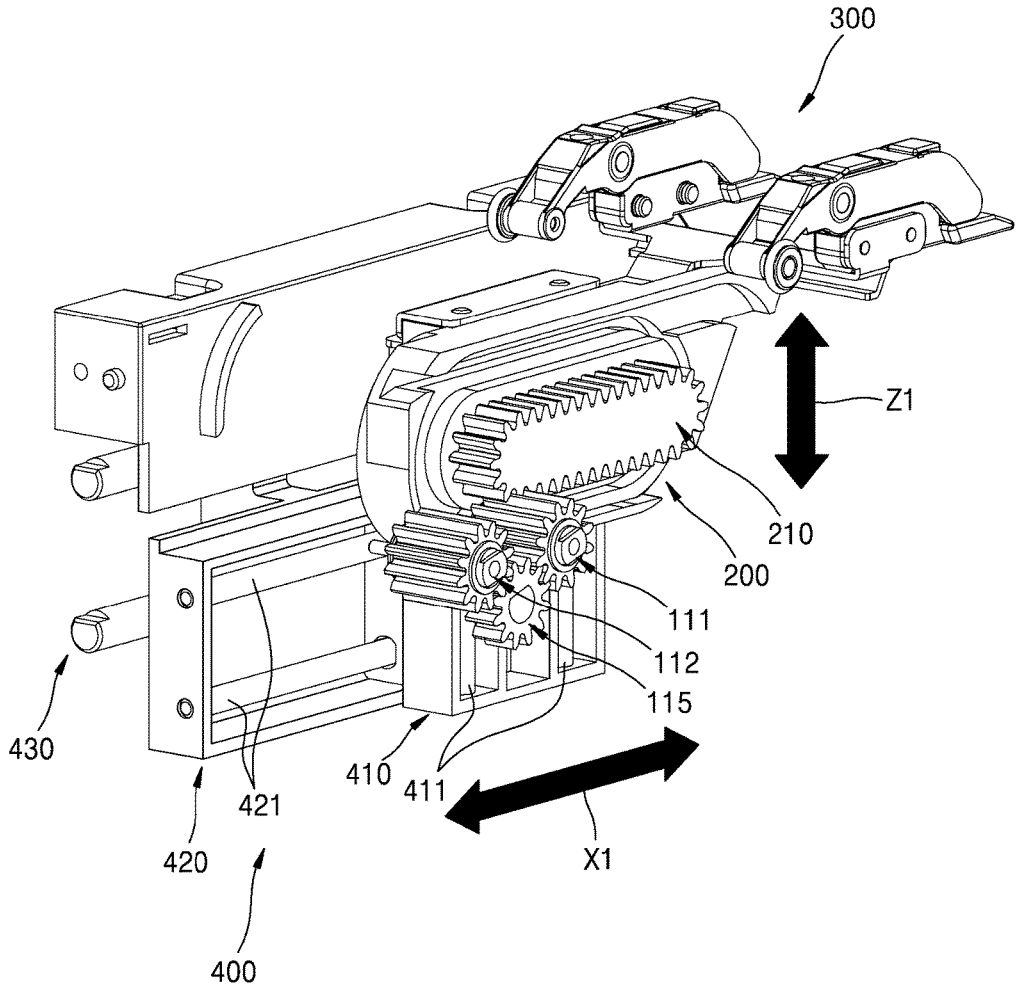
FIGS. 8A and 8B are diagrams for describing a moving guide of a moving structure, according to an example embodiment.
Figure 8B:
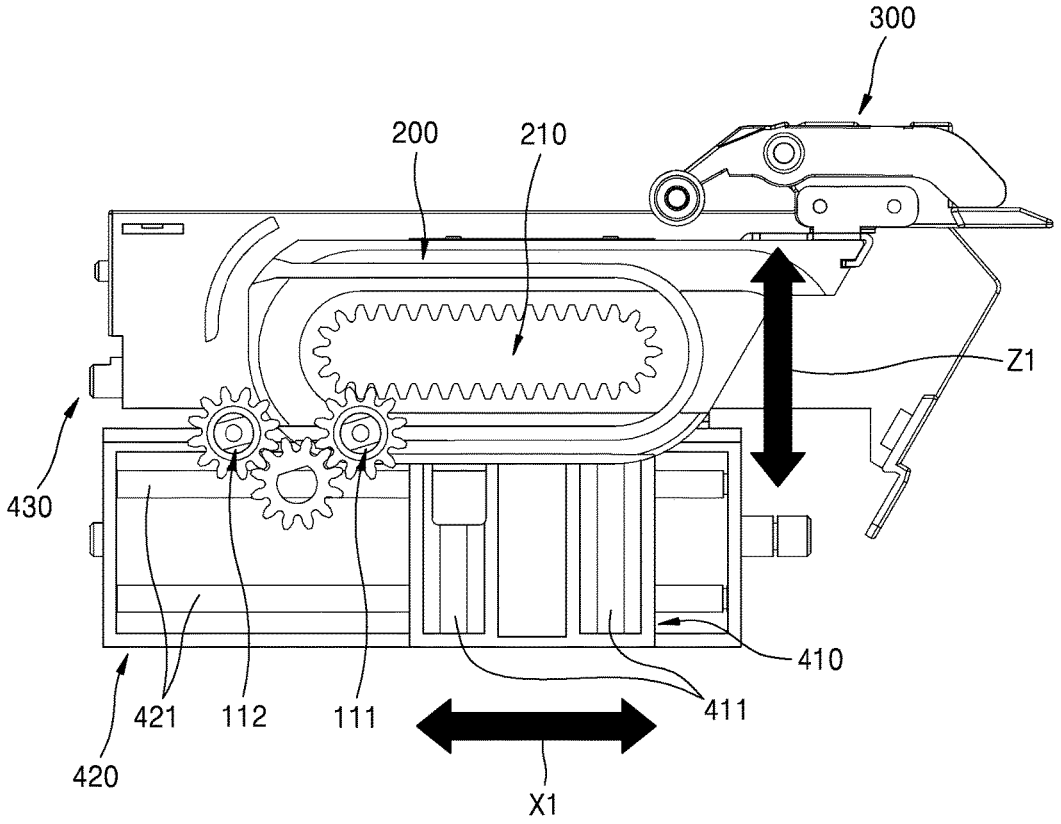

FIGS. 8A and 8B are diagrams for describing a moving guide 400 of a moving structure, according to an example embodiment:

Referring to FIGS. 4A, 8A, and 8B, the moving guide 400 supports the moving member 200 to allow linear movement and curvilinear movement of the moving member 200.

The moving guide 400 includes a first guide 410 supporting the moving member 200 such that moving member 200 is slidable in a first direction Z1 and a second guide 420 supporting the first guide 410 such that the first guide 410 is slidable in a second direction X1 different from the first direction Z1. The moving guide 400 may further include a third guide supporting the second guide 420 such that the second guide 420 is slidable in the second direction X1.

The second direction X1 may be a direction intersecting the first direction Z1. For example, the second direction X1 may be perpendicular to the first direction Z1. For example, the first direction Z1 may be perpendicular to the print medium transporting direction D (refer to FIG. 2), and the second direction X1 may be parallel to the print medium transporting direction D. In another example, although not shown, the first direction Z1 may be parallel to the print medium transporting direction D and the second direction X1 may be perpendicular to the print medium transporting direction D.

The first guide 410 includes a pair of first guide shafts 411 extending in the first direction Z1. The second guide 420 includes a pair of second guide shafts 421 extending in the second direction X1.

Since the moving member 200 may slide due to the first guide 410 and the second guide 420, the moving member 200 may move linearly and curvilinearly without change of the posture (or angle) of the moving member 200.

Referring back to FIGS. 4A and 4B, there may be a plurality of driving gears 111 and 112. For example, the driving gears 111 and 112 includes a first driving gear 111 and a second driving gear 112

Figure 9:
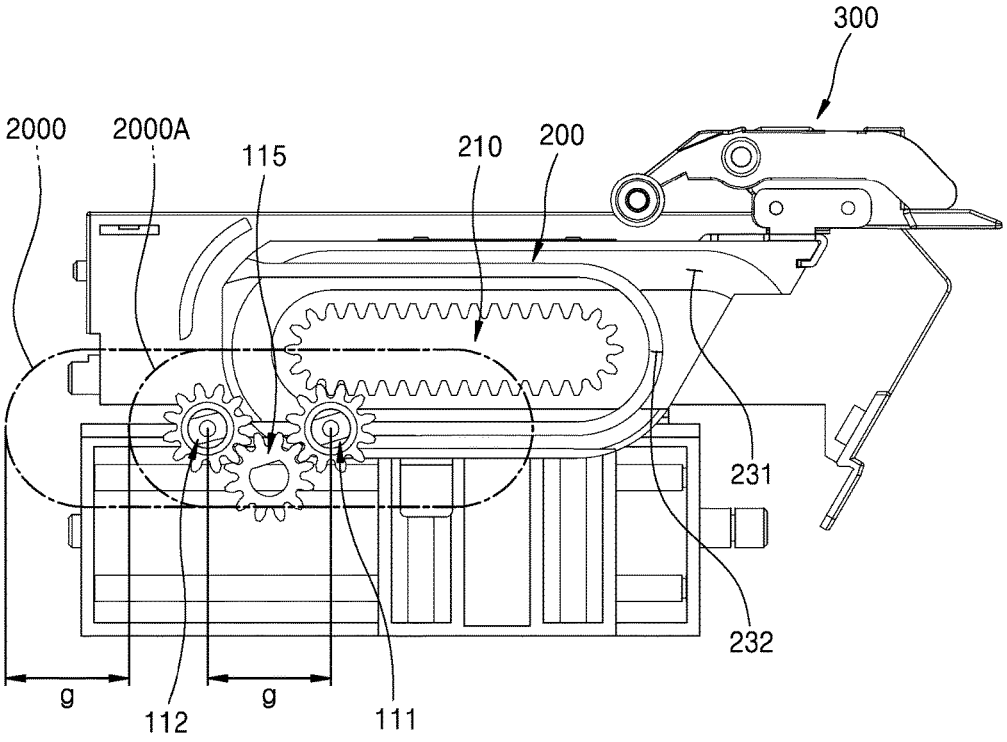
FIG. 9 is a diagram for describing the operations of first and second driving gears of FIG. 4B.
Figure 10:
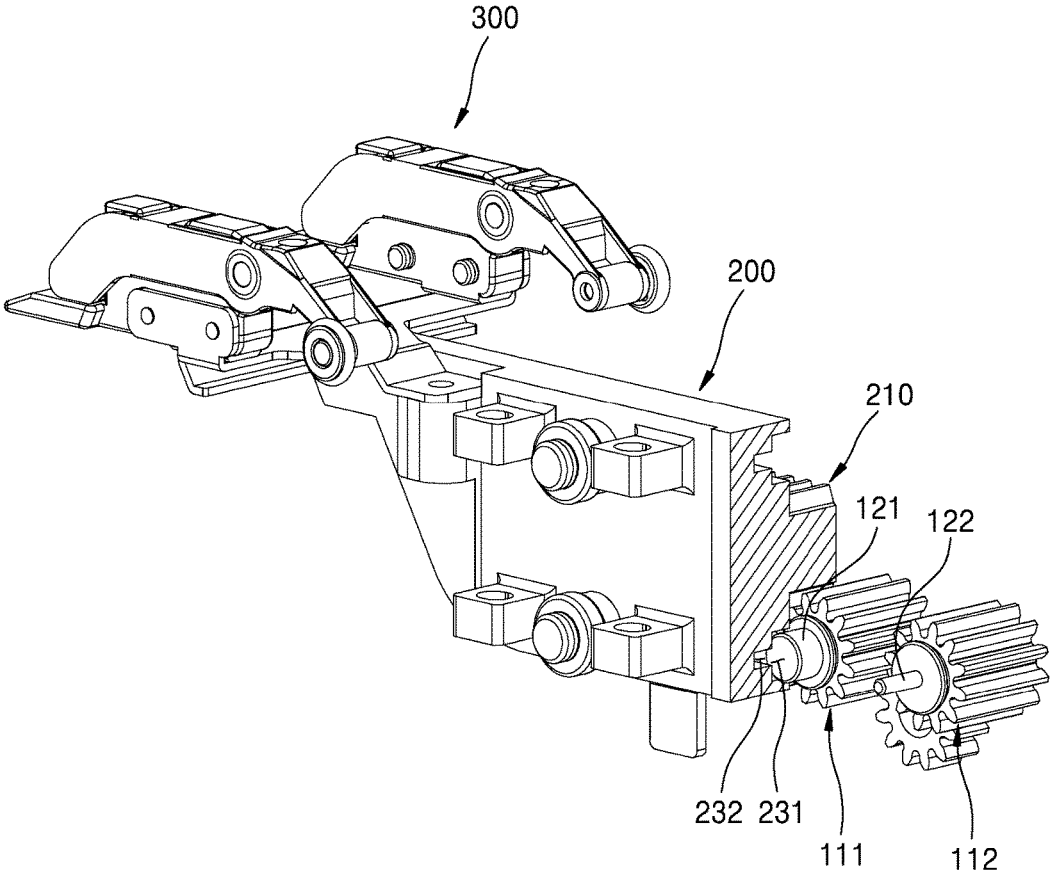
FIG. 10 is a diagram for describing a separation-preventing structure for preventing separation of the first and second driving gears and a motion converting gear from each other.

FIG. 9 is a diagram for describing the operations of the first and second driving gears 111 and 112 of FIG. 4B, and FIG. 10 is a diagram for describing a separation-preventing structure for preventing separation of the first and second driving gears 111 and 112 and the motion converting gear 210 from each other.

Referring to FIGS. 4A, 4B, and 9, the first driving gear 111 and the second driving gear 112 have a same diameter and rotate in a same direction. For example, the first driving gear 111 and the second driving gear 112 may rotate in the clockwise direction. A connecting gear 115 may be disposed between the first driving gear 111 and the second driving gear 112 to interconnect the same.

When the first and second driving gears 111 and 112 are used, the length of the moving path 2000 of the moving member 200 may be increased as compared to that of a moving path 2000A of the moving member 200 in a case in which only the driving gear 111 is used. The length of the moving path 2000 of the moving member 200 may be increased by a distance g between the centers of the first and second driving gears 111 and 112 as compared to the moving path 2000A in the case in which only the driving gear 111 is used. Therefore, the length of the moving path 2000 of the moving member 200 may be increased without increasing the size of the motion converting gear 210.

The separation-preventing structure may include the plurality of separating-preventing grooves 231 and 232 and the plurality of separating-preventing protrusions 121 and 122, such that engagement between at least one of the first and second driving gears 111 and 112 and the motion converting gear 210 is maintained.

Referring to FIGS. 9 and 10, the plurality of separating-preventing grooves 231 and 232 include a first separating-preventing groove 231 having a first width and a first depth, and a second separating-preventing groove 232 having a second width smaller than the first width and a second depth greater than the first depth. The first separating-preventing groove 231 and the second separating-preventing groove 232 may partially overlap each other.

The plurality of separating-preventing protrusions 121 and 122 may include a first separating-preventing protrusion 121 having a first width and a first length and a second separating-preventing protrusion 121 having a second width smaller than the first width and a second length greater than the first length.

While the moving member 200 is moving downward curvilinearly, the first separating-preventing protrusion 121 and the first separating-preventing groove 231 prevent separation of the first driving gear 111 from the motion converting gear 210.

While the moving member 200 is moving upward curvilinearly, the second separating-preventing protrusion 122 and the second separating-preventing groove 232 prevent separation of the second driving gear 112 from the motion converting gear 210.

Figure 11A:
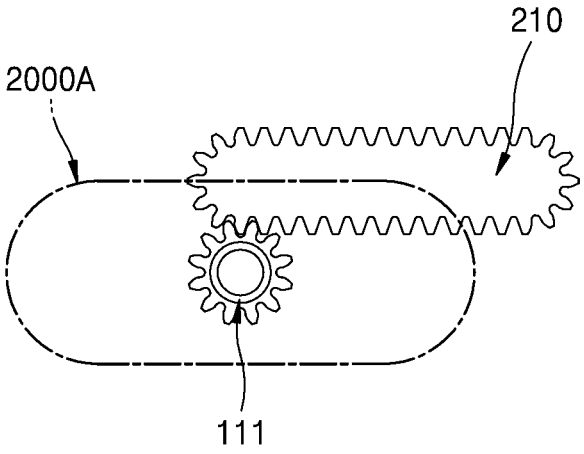
FIGS. 11A and 11B are diagrams for describing a driving gear according to another example embodiment.
Figure 11B:
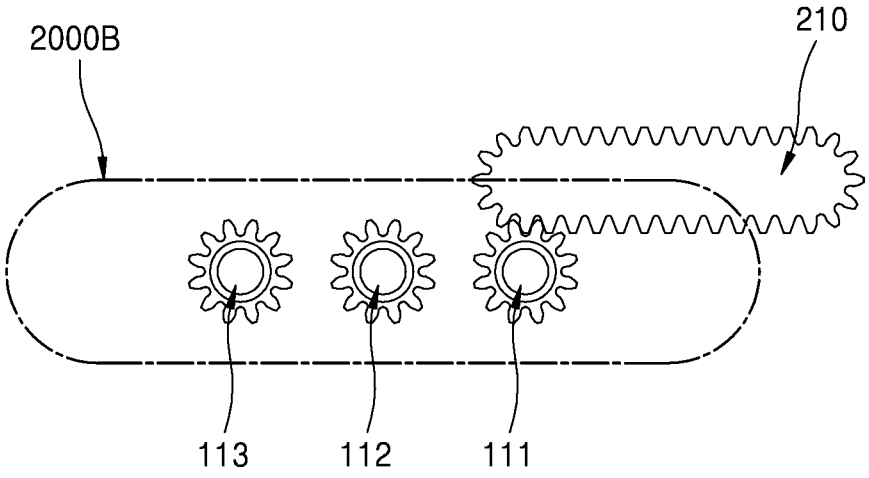

In the above-described embodiment, a case in which there are the two driving gears 111 and 112 has been described. However, the present disclosure is not necessarily limited thereto. For example, there may be one driving gear 111 as shown in FIG. 11A, three driving gears 111, 112, and 113 as shown in FIG. 11B, or more driving gears. In this case, the lengths of the moving path 2000A and a moving path 2000B of the moving member 200 may be reduced or increased.

FIGS. 12A through 12F are diagrams showing a process in which, as the grip member 300 is moved by a moving structure according to an example embodiment, the plurality of print media P are transported from the print medium stacking plate 11 to the stacker tray 13. In FIGS. 12A through 12F, the moving path 3000 of the grip member 300 and the moving path 2000 of the moving member 200 are indicated by dotted lines for convenience of explanation.

Figure 12A:
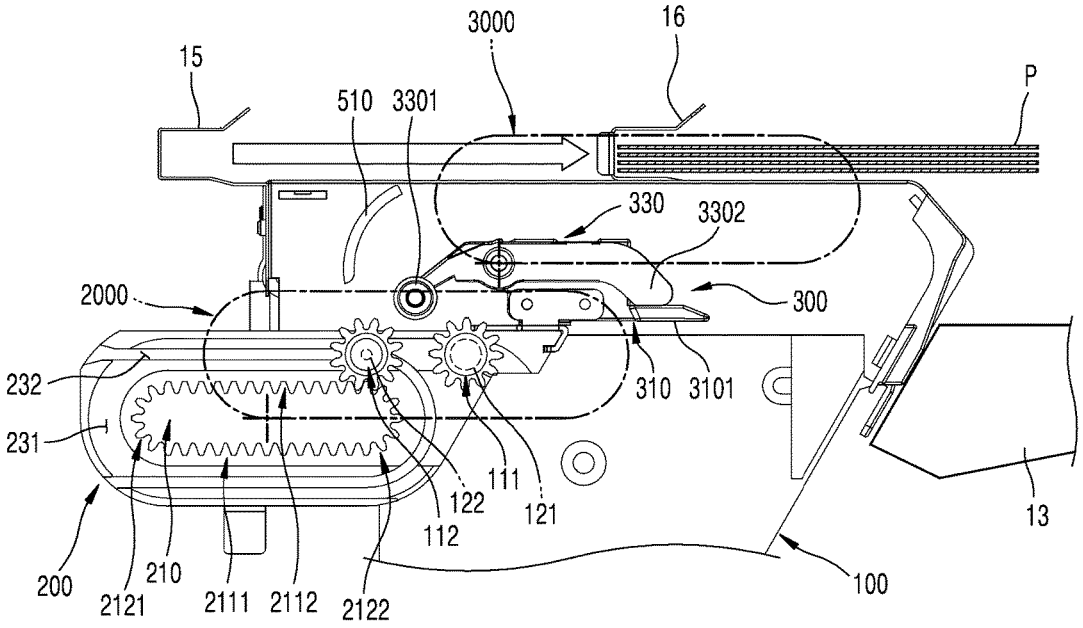
FIGS. 12A through 12F are diagrams showing a process in which, as the grip member is moved by a moving structure according to an example embodiment, a plurality of print media are transported from a print medium stacking plate to a stacker tray.

Referring to FIG. 12A, the second driving gear 112 contacts the second straight gear portion 2112 of the motion converting gear 210, and the first driving gear 111 is apart from the motion converting gear 210. Here, the second separating-preventing protrusion 122 is inserted into the second separating-preventing groove 232 of the motion converting gear 210, and the first separating-preventing protrusion 121 is inserted into the first separating-preventing groove 231 of the motion converting gear 210. The second end 3302 of the gripper 330 of the grip member 300 is pressed onto the grip region 3101 of the base 310.

Figure 12B:
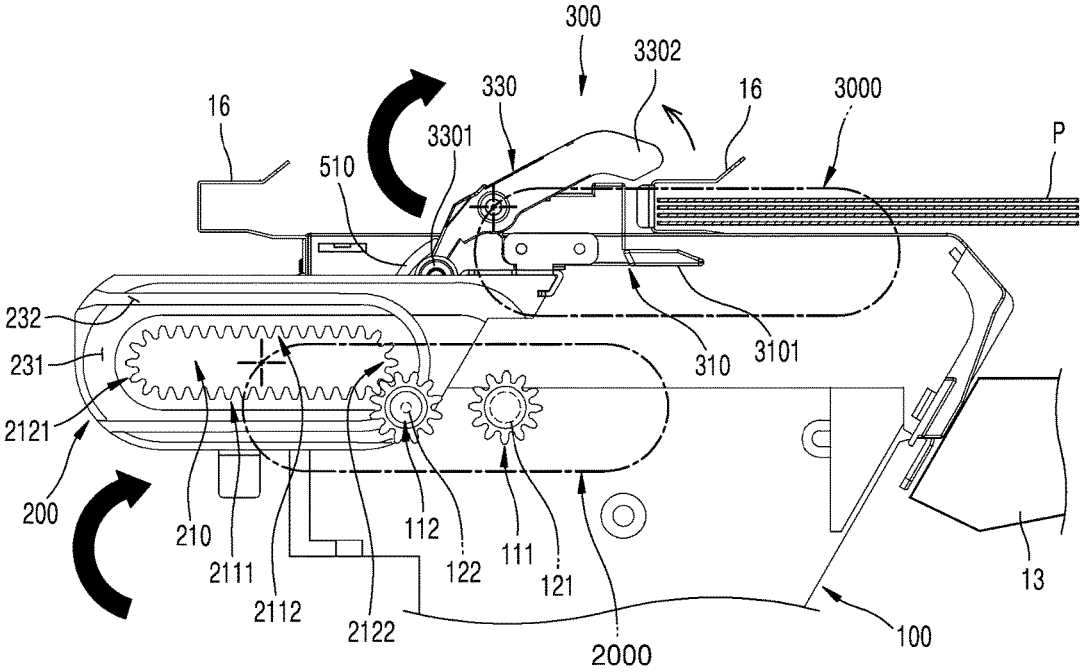

Referring to FIG. 12B, as the first driving gear 111 and the second driving gear 112 rotate in the clockwise direction, the rotating motion of the second driving gear 112 is converted to the curvilinear movement of the motion converting gear 210 by the second curved gear portion 2122. As a result, the moving member 200 including the motion converting gear 210 moves upward curvilinearly. At this time, due to the second separating-preventing protrusion 122 and the second separating-preventing groove 232, the second curved gear portion 2122 of the motion converting gear 210 may not be separated from the second driving gear 112 and contact therebetween may be maintained.

As the moving member 200 moves curvilinearly, the grip member 300 fixed to the moving member 200 also moves curvilinearly along the same path. While the grip member 300 is moving curvilinearly, the first end 3301 of the gripper 330 is pressed by the cam 510. As a result, the gripper 330 rotates in the counterclockwise direction, and thus the print media P may be inserted between the second end 3302 of the gripper 330 and the base 310 of the grip member 300.

Figure 12C:
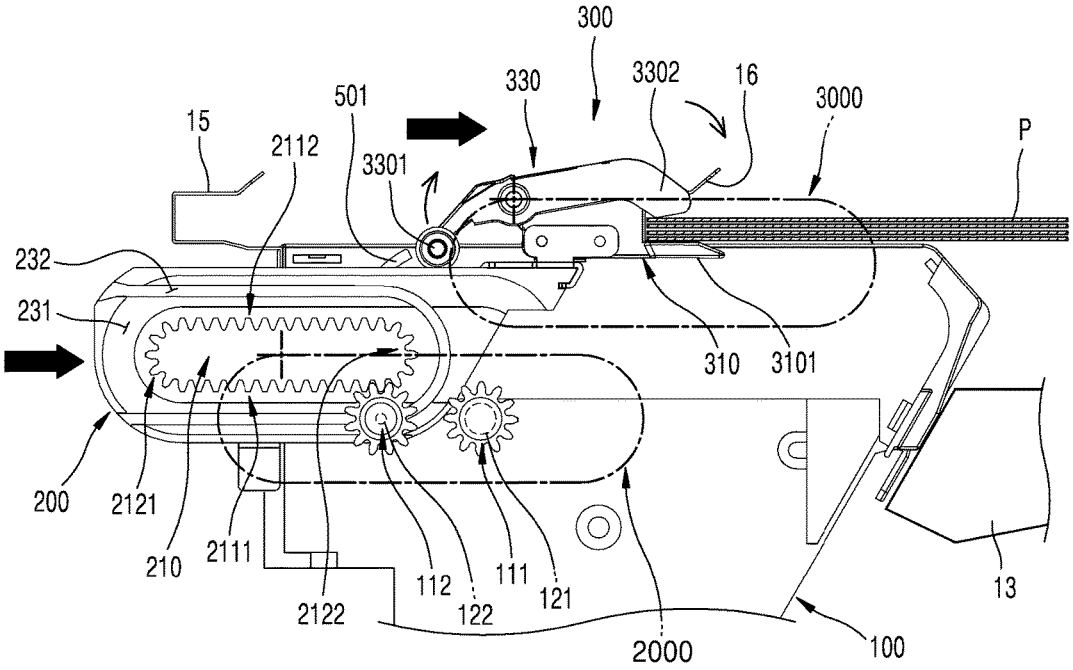
Figure 12D:
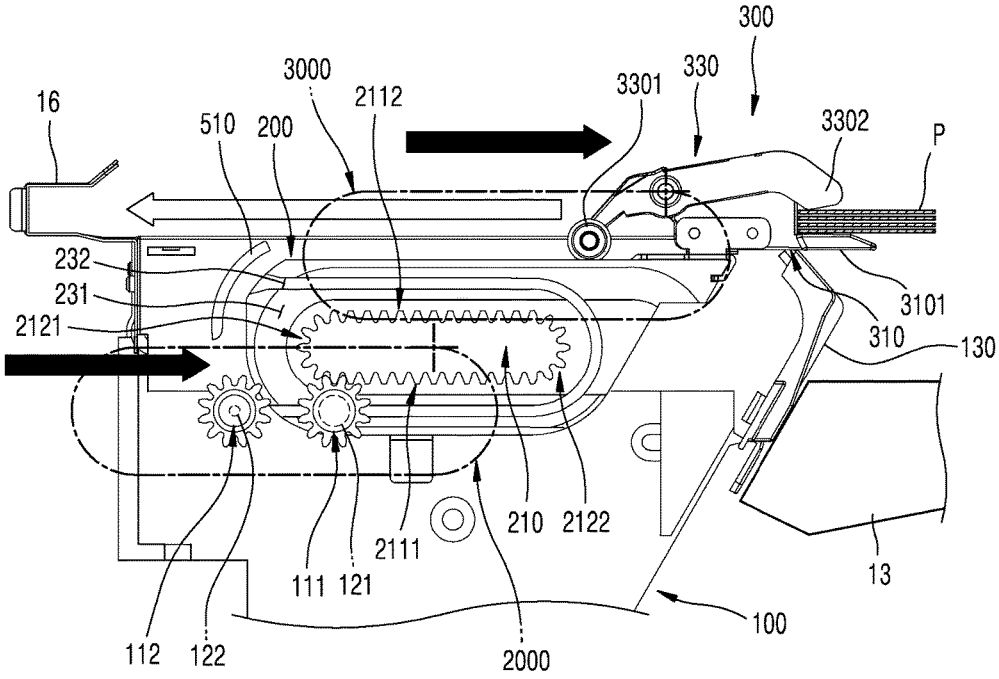

Referring to FIGS. 12C and 12D, as the first driving gear 111 and the second driving gear 112 rotate in the clockwise direction, rotation of the second driving gear 112 and rotation of the first driving gear 112 are converted into linear movement of the motion converting gear 210 by the first straight gear portion 2111. Therefore, the moving member 200 including the motion converting gear 210 moves linearly in the print medium discharging direction D. Here, due to the first and second separating-preventing protrusions 121 and 122 and the first and second separating-preventing grooves 231 and 232, the first straight gear portion 2111 of the motion converting gear 210 may not be separated from at least one of the first and second driving gears 111 and 112 and contact therebetween may be maintained.

Due to the linear movement of the moving member 200, the grip member 300 fixed to the moving member 200 also moves linearly in the print medium discharging direction D.

While the grip member 300 is moving linearly, the first end 3301 of the gripper 330 and the cam 510, which are in contact with each other, are separated. Therefore, the base 310 is rotated in a clockwise direction by the elastic bias, and the print media P disposed between the second end 3302 of the gripper 330 and the base 310 are pressed by the second end 3302 of the gripper 330. The plurality of print media P are held by the grip member 300.

As the grip member 300 moves linearly while the plurality of print media P are being held by the grip member 300, the plurality of print media P held by the grip member 300 moves linearly while alignment thereof is maintained. At this time, the movable stopper 16 moves in a direction opposite to the moving direction of the grip member 300 and returns to its original position.

Figure 12E:
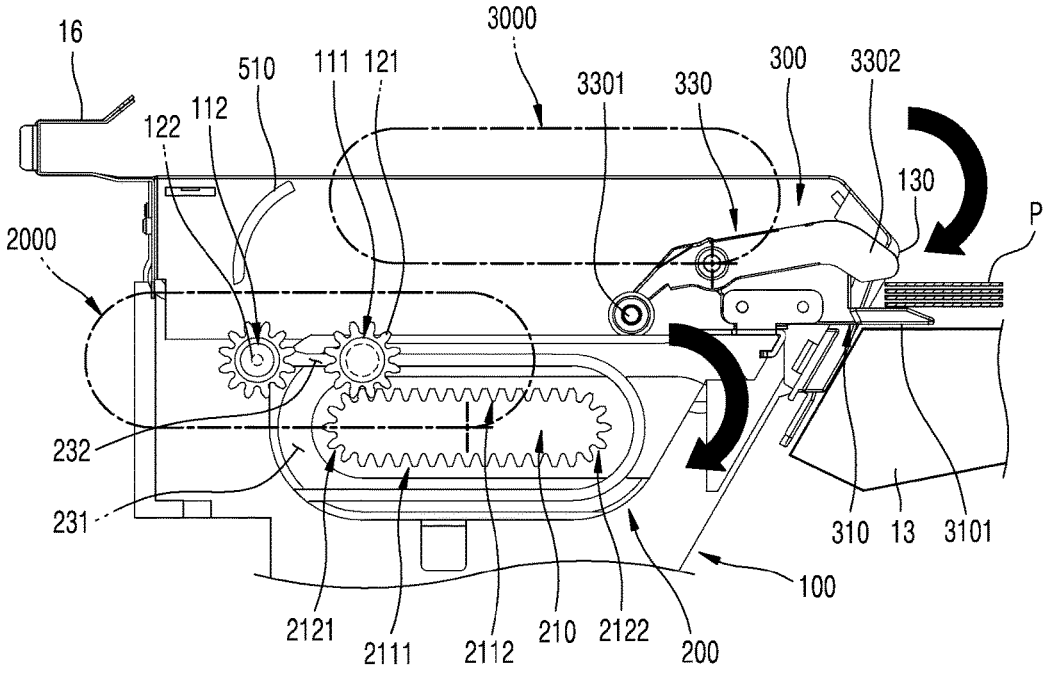

Referring to FIG. 12E, as the first driving gear 111 and the second driving gear 112 rotate in a clockwise direction, the rotating motion of the first gear 111 is converted to curvilinear movement of the motion converting gear 210 by the first curved gear portion 2121. Therefore, the moving member 200 including the motion converting gear 210 moves downward curvilinearly. At this time, due to the first separating-preventing protrusion 121 and the first separating-preventing groove 231, the first curved gear portion 2121 of the motion converting gear 210 may not be separated from the first driving gear 111 and contact therebetween may be maintained.

As the moving member 200 moves curvilinearly, the grip member 300 fixed to the moving member 200 also moves curvilinearly along the same path. The grip member 300 moves downward curvilinearly while holding the plurality of print media P. The grip member 300 moves downward and forward in some sections and moves downward and backward in some other sections. During these processes, the plurality of print media P are placed on the stacker tray 13 while being held by the grip member 300.

Figure 12F:
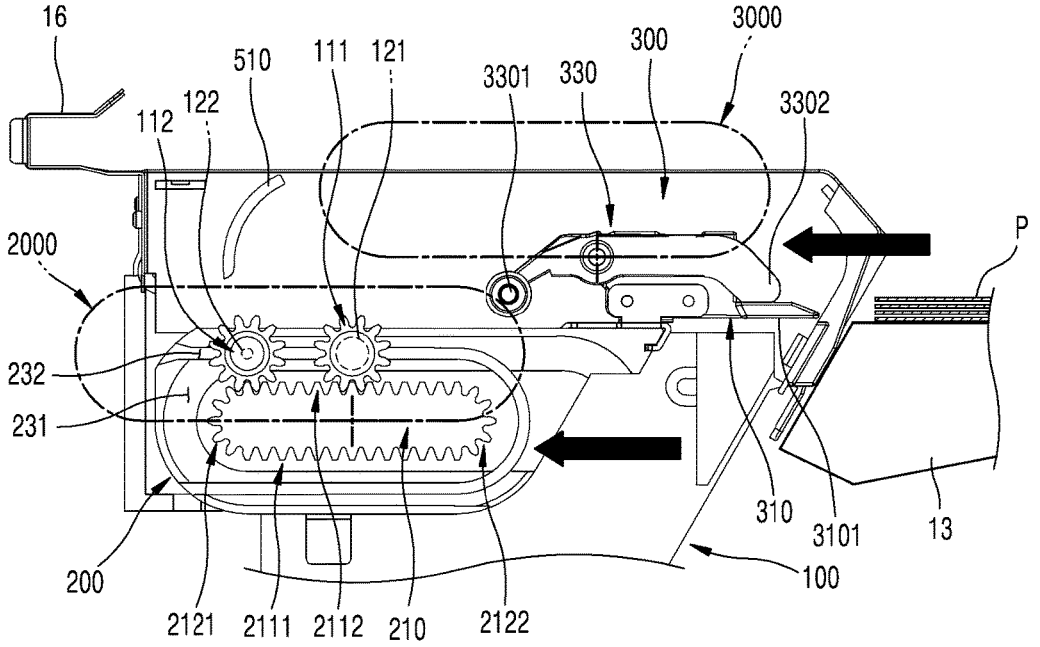

Referring to FIG. 12F, as the first driving gear 111 and the second driving gear 112 rotate in a clockwise direction, rotation of the first driving gear 111 and rotation of the second driving gear 112 are converted into linear movement of the motion converting gear 210 by the second straight gear portion 2112. Therefore, the moving member 200 including the motion converting gear 210 moves in a direction opposite to the print medium discharging direction D. Due to the first and second separating-preventing protrusions 121 and 122 and the first and second separating-preventing grooves 231 and 232, the second straight gear portion 2112 of the motion converting gear 210 may not be separated from at least one of the first and second driving gears 111 and 112 and contact therebetween may be maintained.

Due to the linear movement of the moving member 200, the grip member 300 fixed to the moving member 200 also moves linearly in a direction opposite to the print medium discharging direction D.

Movement of the plurality of print media P is restricted by walls of the print medium discharging apparatus 100 while the grip member 300 is moving in the direction opposite to the print medium discharging direction D. Therefore, the plurality of print media P are separated from the grip member 300 and placed on the stacker tray 13 in an aligned state.

Meanwhile, in the above-described embodiments, an elliptical gear of which both ends have a semicircular form is provided as an example of the motion converting gear 210.

Figure 13A:
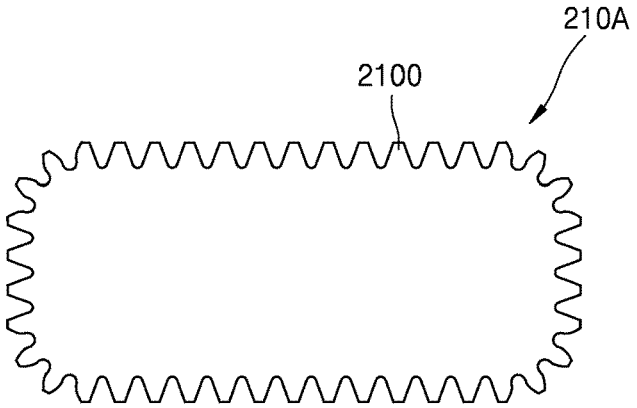
FIGS. 13A through 13C are diagrams for describing a motion converting gear according to another example embodiment.
Figure 13B:
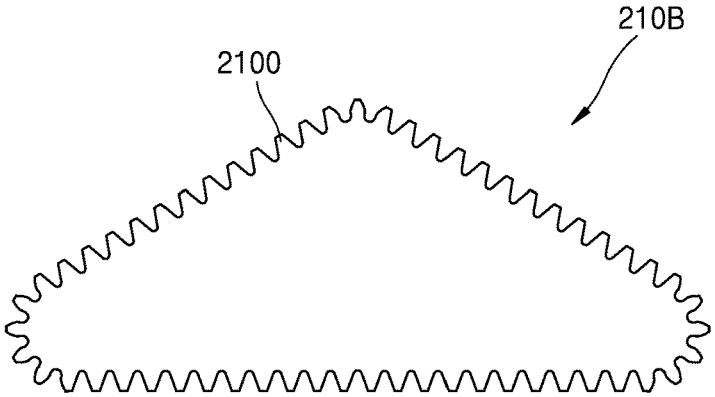
Figure 13C:
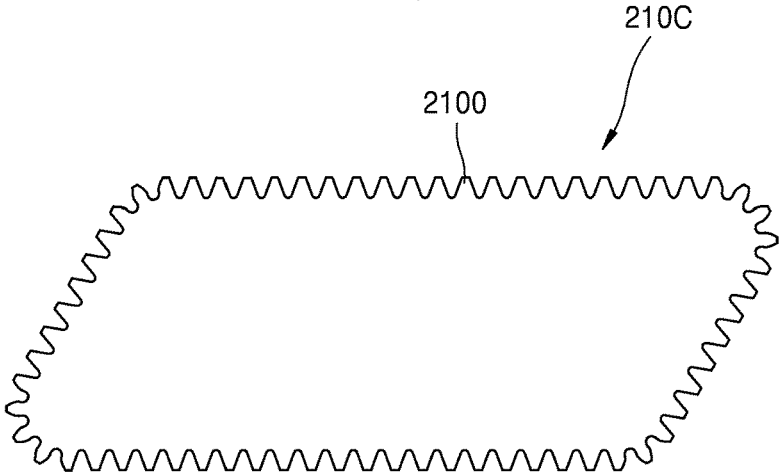

However, the form of the motion converting gear 210 is not limited thereto, and the form of the motion converting gear 210 may be freely modified as long as the motion converting gear 210 includes the straight gear portion 2111 for linearly transporting aligned print media and at least one of the curved gear portions 2121 and 2122 interconnecting both ends of the straight gear portion 2111. For example, as shown in FIG. 13A, the plurality of gear teeth 2100 of a motion converting gear 210A may be arranged so as to form a rectangular shape with rounded corners. In another example, as shown in FIG. 13B, the plurality of gear teeth 2100 of a motion converting gear 210B may be arranged so as to form a triangular shape with rounded corners. In another example, as shown in FIG. 13C, the plurality of gear teeth 2100 of a motion converting gear 210C may be arranged so as to form a parallelogram shape with rounded corners.

A print medium finishing apparatus, an image forming system, and a moving structure included therein, according to example embodiments, may control a position of a grip member while having a simple structure.

A print medium finishing apparatus, an image forming system, and a moving structure included therein, according to another example embodiment, may be miniaturized while having a simple structure.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A print medium finishing apparatus comprising:

a print medium stacking plate;

a stacker tray disposed at a location lower than the print medium stacking plate; and a print medium discharging apparatus configured to discharge print media on the print medium stacking plate to the stacker tray, the print medium discharging apparatus comprising:

at least one driving gear that is rotatable;

a moving member configured to move in a linear motion and a curvilinear motion with respect to the at least one driving gear, the moving member comprising:

a motion converting gear configured to engage the at least one driving gear to convert rotation of the at least one driving gear into the linear motion and the curvilinear motion; and a grip member configured to:

hold the print media on the print medium stacking plate, and be moved linearly and curvilinearly by the moving member moving in the linear motion and the curvilinear motion, while holding the print media on the print medium stacking plate, to thereby discharge the print media and place the print media on the stacker tray.

2. The print medium finishing apparatus of claim 1, wherein the at least one driving gear comprises a separating-preventing protrusion, and the moving member comprises a separating-preventing groove capable of accommodating the separating-preventing protrusion and extending so as to be apart from and in a constant distance with the motion converting gear.

3. The print medium finishing apparatus of claim 2, wherein the motion converting gear comprises:

at least one straight gear portion in which a plurality of gear teeth are arranged linearly;

a first curved gear portion arranged at a first end of the at least one straight gear portion and comprising a plurality of gear teeth arranged curvilinearly; and a second curved gear portion arranged at a second end of the at least one straight gear portion and comprising a plurality of gear teeth arranged curvilinearly.

4. The print medium finishing apparatus of claim 3, wherein the at least one straight gear portion comprises a first straight gear portion and a second straight gear portion that are parallel to each other, the first curved gear portion is configured to interconnect a first end of the first straight gear portion and a first end of the second straight gear portion, and the second curved gear portion is configured to interconnect a second end of the first straight gear portion and a second end of the second straight gear portion.

5. The print medium finishing apparatus of claim 3, wherein a path along which the moving member moves comprises:

a straight path parallel to the at least one straight gear portion, a first curved path parallel to the first curved gear portion, and a second curved path parallel to the second curved gear portion.

6. The print medium finishing apparatus of claim 5, wherein the grip member is fixed to the moving member, and the path along which the grip member moves is identical to the path along which the moving member moves.

7. The print medium finishing apparatus of claim 2, further comprising a moving guide that movably supports the moving member, wherein the moving guide comprises:

a first guide configured to support the moving member such that the moving member is slidable in a first direction, and a second guide configured to support the first guide such that the first guide is slidable in a second direction different from the first direction.

8. The print medium finishing apparatus of claim 2, wherein the motion converting gear and the at least one driving gear are configured to circumscribe each other.

9. The print medium finishing apparatus of claim 2, wherein the at least one driving gear comprises a first driving gear and a second driving gear.

10. The print medium finishing apparatus of claim 9, wherein the separating-preventing protrusion comprises:

a first separating-preventing protrusion disposed at the first driving gear and having a first length, and a second separating-preventing protrusion disposed at the second driving gear and having a second length greater than the first length, and the separating-preventing groove comprises:

a first separating-preventing groove capable of accommodating the first separating-preventing protrusion and having a first depth, and a second separating-preventing groove capable of accommodating the second separating-preventing protrusion and having a second depth greater than the first depth.

11. An image forming system comprising:

an image forming apparatus configured to form an image on at least one print medium of print media; and a print medium finishing apparatus configured to align the print media including the at least one print medium having images formed thereon, wherein the print medium finishing apparatus comprises:

a print medium stacking plate;

a stacker tray disposed at a location lower than the print medium stacking plate; and a print medium discharging apparatus configured to discharge the print media on the print medium stacking plate to the stacker tray, the print medium discharging apparatus comprising:

at least one driving gear that is rotatable;

a moving member configured to move in a linear motion and a curvilinear motion with respect to the at least one driving gear, the moving member comprising:

a motion converting gear configured to engage the at least one driving gear to convert rotation of the at least one driving gear into the linear motion and the curvilinear motion; and a grip member configured to:

hold the print media on the print medium stacking plate, and be moved linearly and curvilinearly by the moving member moving in the linear motion and the curvilinear motion, while holding the print media on the print medium stacking plate, to thereby discharge the print media and place the print media on the stacker tray.

12. The image forming system of claim 11, wherein the at least one driving gear comprises a separating-preventing protrusion, and the moving member comprises a separating-preventing groove capable of accommodating the separating-preventing protrusion and extending so as to be apart from and in a constant distance with the motion converting gear.

13. The image forming system of claim 12, wherein the motion converting gear comprises:

at least one straight gear portion in which a plurality of gear teeth are arranged linearly;

a first curved gear portion arranged at a first end of the at least one straight gear portion and comprising a plurality of gear teeth arranged curvilinearly; and a second curved gear portion arranged at a second end of the at least one straight gear portion and comprising a plurality of gear teeth arranged curvilinearly.

14. The image forming system of claim 13, wherein the at least one straight gear portion comprises a first straight gear portion and a second straight gear portion that are parallel to each other, the first curved gear portion is configured to interconnect a first end of the first straight gear portion and a first end of the second straight gear portion, and the second curved gear portion is configured to interconnect a second end of the first straight gear portion and a second end of the second straight gear portion.

15. The image forming system of claim 13, wherein a path along which the moving member moves comprises:

a straight path parallel to the at least one straight gear portion, a first curved path parallel to the first curved gear portion, and a second curved path parallel to the second curved gear portion.

16. The image forming system of claim 12, further comprising a moving guide that movably supports the moving member, wherein the moving guide comprises a first guide configured to support the moving member such that the moving member is slidable in a first direction, and a second guide configured to support the first guide such that the first guide is slidable in a second direction different from the first direction.

17. The image forming system of claim 12, wherein the motion converting gear and the at least one driving gear are configured to circumscribe each other.

18. The image forming system of claim 12, wherein the at least one driving gear comprises a first driving gear and a second driving gear.

19. The image forming system of claim 18, wherein the separating-preventing protrusion comprises:

a first separating-preventing protrusion disposed at the first driving gear and having a first length, and a second separating-preventing protrusion disposed at the second driving gear and having a second length greater than the first length, and the separating-preventing groove comprises:

a first separating-preventing groove capable of accommodating the first separating-preventing protrusion and having a first depth, and a second separating-preventing groove capable of accommodating the second separating-preventing protrusion and having a second depth greater than the first depth.

* * * * *